US009347707B2

(12) United States Patent
Struschka et al.

(10) Patent No.: US 9,347,707 B2
(45) Date of Patent: May 24, 2016

(54) ROTARY DRUM FOR USE IN A VACUUM FREEZE-DRYER

(71) Applicant: Sanofi Pasteur SA, Lyons (FR)

(72) Inventors: Manfred Struschka, Auggen (DE); Matthias Plitzko, Neuenburg (DE); Thomas Gebhard, Kandern (DE); Bernhard Luy, Freiburg (DE)

(73) Assignee: Sanofi Pasteur SA, Lyons (FR)

( * ) Notice: Subject to any disclaimer, the term of this patent is extended or adjusted under 35 U.S.C. 154(b) by 0 days.

(21) Appl. No.: 14/349,028

(22) PCT Filed: Oct. 4, 2012

(86) PCT No.: PCT/EP2012/004163

§ 371 (c)(1),
(2) Date: Jul. 3, 2014

(87) PCT Pub. No.: WO2013/050157

PCT Pub. Date: Apr. 11, 2013

(65) Prior Publication Data

US 2014/0373383 A1 Dec. 25, 2014

(30) Foreign Application Priority Data

Oct. 6, 2011 (EP) ..... 11008109

(51) Int. Cl.
*F26B 25/16* (2006.01)
*F26B 5/06* (2006.01)

(52) U.S. Cl.
CPC . *F26B 5/065* (2013.01); *F26B 5/06* (2013.01); *F26B 25/16* (2013.01)

(58) Field of Classification Search
CPC ..... F26B 3/00; F26B 3/30; F26B 25/00; F26B 25/16; A23K 1/00; A23K 1/18; F25C 1/00
USPC ..... 34/284, 287, 292, 301, 92; 62/54.1, 64, 62/346; 366/131
See application file for complete search history.

(56) References Cited

U.S. PATENT DOCUMENTS 2,388,917 A 11/1945 Hormel
3,088,222 A * 5/1963 Mace et al. ..... 34/92

(Continued)

FOREIGN PATENT DOCUMENTS

DE 196 54 134 C2 11/1997
GB 1328027 A * 8/1973

(Continued)

OTHER PUBLICATIONS

International Search Report and Written Opinion received in connection with international application No. PCT/EP2012/004163; mailed Nov. 7, 2012.

(Continued)

*Primary Examiner* — Stephen M Gravini

(57) ABSTRACT

A rotary drum (302) for use within a vacuum chamber (212) in a vacuum freeze-dryer (204) for the bulkware production of freeze-dried particles is provided. The drum (302) is in open communication with the vacuum chamber (212) and comprises a main section (304) terminated by a front plate (306) and a rear plate (308), the rear plate (308) is adapted for connection with a rotary supporting shaft (312) for rotary support of the drum (302), and the rear plate (308) is permeable for sublimation vapor from freeze-drying the particles.

17 Claims, 7 Drawing Sheets

(56) References Cited

U.S. PATENT DOCUMENTS

| | | | | | |
|---|---|---|---|---|---|
| 3,303,578 | A | | 2/1967 | Rockwell et al. | |
| 3,445,247 | A | * | 5/1969 | Baerwald | 426/640 |
| 3,477,137 | A | * | 11/1969 | Van Gelder | 34/287 |
| 3,824,703 | A | * | 7/1974 | Moyne | 34/130 |
| 3,837,271 | A | * | 9/1974 | Shore et al. | 99/468 |
| 4,016,657 | A | * | 4/1977 | Passey, now by change of name Chand Arjun Passey | 34/92 |
| 5,928,678 | A | * | 7/1999 | Lund | 425/207 |
| 8,516,714 | B2 | * | 8/2013 | Biemans et al. | 34/284 |
| 8,528,225 | B2 | * | 9/2013 | Weisselberg | 34/284 |
| 2014/0230266 | A1 | | 8/2014 | Luy et al. | |
| 2014/0237846 | A1 | | 8/2014 | Plitzko et al. | |
| 2014/0245629 | A1 | | 9/2014 | Luy et al. | |
| 2014/0373383 | A1 | * | 12/2014 | Struschka et al. | 34/287 |
| 2015/0007445 | A1 | | 1/2015 | Gebhard et al. | |

FOREIGN PATENT DOCUMENTS

| | | | |
|---|---|---|---|
| WO | WO 2012/087232 | * | 6/2012 |
| WO | WO 2013/050156 | | 10/2012 |
| WO | WO 2013/050158 | | 10/2012 |
| WO | WO 2013/050161 | | 10/2012 |
| WO | WO 2013/050162 | | 10/2012 |
| WO | WO 2013/050156 | | 4/2013 |
| WO | WO 2013/050158 | | 4/2013 |
| WO | WO 2013/050161 | | 4/2013 |
| WO | WO 2013/050162 | | 4/2013 |

OTHER PUBLICATIONS

Letter and Article 34 Amendments submitted in connection with international application No. PCT/EP2012/004163; dated Jul. 31, 2013.

Written Opinion of the International Preliminary Examining Authority received in connection with international application No. PCT/EP2012/004163; mailed Sep. 25, 2013.

Response submitted in connection with international application No. PCT/EP2012/004163; dated Dec. 10, 2013.

International Preliminary Report on Patentability received in connection with international application No. PCT/EP2012/004163; mailed Jan. 9, 2014.

European Search Report and the European Search Opinion Dated Mar. 12, 2012 From the European Patent Office Re. Application No. 11008109.8.

* cited by examiner

ROTARY DRUM FOR USE IN A VACUUM FREEZE-DRYER

TECHNICAL FIELD

The invention relates to the general field of freeze-drying of, for example, pharmaceuticals, biopharmaceuticals, and vaccines, and other high-valued goods. More specifically, the invention relates to a rotary drum for use in a vacuum freeze-dryer for the bulkware production of freeze-dried particles.

BACKGROUND OF THE INVENTION

Freeze-drying, also known as lyophilization, is a process for drying high-quality products such as, for example, pharmaceuticals, biological materials such as proteins, enzymes, microorganisms, and in general any thermo- and/or hydrolysis-sensitive materials. Freeze-drying provides for drying of the target product via sublimation of ice crystals into water vapor, i.e., via the direct transition of at least a portion of the water content of the product from the solid phase into the gas phase.

Freeze-drying processes in the pharmaceutical area may be employed, for example, for the drying of drugs, drug formulations, Active Pharmaceutical Ingredients ("APIs"), hormones, peptide-based hormones, carbohydrates, monoclonal antibodies, blood plasma products or derivatives thereof, immunological compositions including vaccines, therapeutics, other injectables, and in general substances which otherwise would not be stable over a desired time span. In order for a freeze-dried product to be stored and shipped, the water (or other solvent) has to be removed prior to sealing the product in vials or containers for preserving sterility and/or containment. In the case of pharmaceutical and biological products, the lyophilized product may be re-constituted later by dissolving the product in a suitable reconstituting medium (e.g., pharmaceutical grade diluent) prior to administration, e.g., injection.

A freeze-dryer is generally understood as a process device employed in a process line for the production of freeze-dried particles such as granules or pellets with sizes ranging typically ranging from several micrometers to several millimeters. Freeze-drying may be performed under arbitrary pressure conditions, e.g., atmospheric pressure conditions, but may efficiently (in terms of drying time scales) be performed under vacuum conditions (i.e., defined low-pressure conditions).

Drying the particles as bulkware may generally provide for a higher drying efficiency than drying the particles after filling into vials or containers. Various approaches for (bulk) freeze-dryer designs comprise employing a rotary drum for receiving the particles. The effective product surface may be increased by the rotating drum which may lead, in turn, to an accelerated mass and heat transfer as compared to drying the particles in vials or as bulkware dried in stationary trays. Generally, bulk drum-based drying can lead to homogeneous drying conditions for the entire batch.

DE 196 54 134 C2 describes a device for freeze-drying products in a rotatable drum. The drum is filled with the bulk product and is slowly rotated in order to achieve a steady heat transfer between product and inner wall of the drum. The inner wall of the drum can be heated by a heating means provided in the annular space between the drum and a chamber housing the drum. Cooling can be achieved by a cryogenic medium inserted into the annular space. The vapor released by sublimation from the product is drawn off the drum. In this approach a vacuum is provided inside the drum, which leads to a complex mechanical configuration wherein, for example, a vacuum pump has to be connected in a vacuum-tight manner (vacuum-sealed) to the interior of the rotating drum. Further, any equipment (or supply lines thereto) related to cooling, heating, sensing of process conditions, cleaning, and sterilization has to be adapted to preserve the vacuum-tight property of the rotary drum.

For efficient freeze-drying under vacuum conditions, sublimation of vapor from the particles may include maximizing effective product surface area by rotation of a drum and be further promoted by providing, for example, optimized process conditions for the particles. For example, a heating mechanism may be provided in the chamber and/or drum to keep the temperature near an optimum value during freeze-drying.

One of the problems that can occur during efficiently driven freeze-drying processes is that the escaping vapor when drawn out of the drum/process chamber can attain detrimentally high velocities. In fact, the flow of escaping sublimation vapor may cause "choked flow conditions" (also sometimes referred to as "choke flow conditions"), wherein the velocity of the escaping vapor approaches a physically determined fixed maximum value, i.e., becomes choked, as it leaves the drum. However, in many instances the interaction between the vapor flow and the particles in the drum gets stronger as the particles become smaller. As a consequence, for pellets or granules in the sub-millimeter size range the interaction becomes powerful enough that the escaping vapor at or near choked flow conditions can sweep an undesirably large fraction of the product out of the drum. Besides negatively affecting production efficiency in terms of lost product, problems associated with bulk dryness may occur such as insufficiently dried particles carried out of the drum subsequently mixed during discharging with the sufficiently dried particles. Problems with cleaning and/or sterilization can also occur.

Some of these problems can be ameliorated by decreasing the velocity (or mass) of the vapor flow, and thereby the momentum which is transferred to particles crossing the flow inside the rotating drum. However, such approaches generally come at the cost of substantially decreasing drying efficiency in terms of drying times. For example, measures such as adapting the vacuum conditions to reduce the escape velocities of the vapor, controlling a lower temperature within the process volume, and/or reducing the effective product surface by slowing down the rotation of the drum, all tend to lengthen the time required to obtain the desired level of product dryness.

SUMMARY OF THE INVENTION

It is one object of the present invention to provide a freeze-dryer design wherein at least one open rotary drum is housed inside at least one vacuum chamber. The present invention contemplates that this design approach provides efficient freeze-drying of sub-millimeter sized particles in terms of decreased drying times while minimizing the loss of particles from the drum due to momentum transfer of the escaping sublimation vapor.

According to one embodiment of the invention, a rotary drum for use in a vacuum freeze-dryer for the bulkware production of freeze-dried particles is provided. The drum is in open communication with the vacuum chamber and optionally comprises a main section terminated by front and rear plates. In preferred embodiments, the rear plate is adapted for connection with a rotary supporting shaft for rotary support of the drum. Further, the rear plate is permeable for sublimation vapor from freeze-drying the particles.

As used herein, the term "production" includes, but is not limited to, the production or processing of freeze-dried particles for commercial purposes, but also includes production for development purposes, test purposes, research purposes, and for the submission of data to any regulatory body or organization and the like. In particular embodiments, the processing of particles in the drum comprises at least the steps of loading the particles to be dried into the drum, freeze-drying the particles in the drum, and unloading the dried particles from the drum. The particles can comprise granules or pellets, wherein the term "pellets" preferably refers to particles with a tendency to be round, while the term "granules" preferably refers to irregularly formed particles. In one example, the particles may comprise micropellets, i.e., pellets with sizes in the micrometer range. According to one specific example, a freeze-dryer is adapted for the production of essentially round freeze-dried micropellets with a mean value for the diameters thereof selected from within a range of about 200 to 800 micrometers (μm), and preferably with a narrow particle size distribution of about, for example, ±50 μm around the selected value.

The term "bulkware" as used herein, can be broadly understood as referring to a system or ensemble of particles which contact each other, i.e. the system comprises multiple particles, microparticles, pellets, and/or micropellets. For example, the term "bulkware" may refer to a loose amount of pellets constituting at least a part of a product flow, for example, a batch of a product to be processed in a process device such as a freeze-dryer or a process line including the freeze-dryer, wherein the bulkware is loose in the sense that it is not filled in vials, containers, or other recipients for carrying or conveying the particles/pellets within the process device or process line. A similar meaning holds true for the term "bulk".

The bulkware described herein will normally refer to a quantity of particles (pellets, etc.) exceeding a (secondary or final) packaging or dose intended for a single patient. The quantity of bulkware may relate to a primary packaging, for example, a production run may comprise production of bulkware sufficient to fill one or more Intermediate Bulk Containers (IBCs).

A freeze-dryer is generally understood as a process device which in turn is a device providing a process volume, within which process conditions such as pressure, temperature, humidity (i.e., vapor-content, often water vapor, more generally vapor of any sublimating solvent) etc., are controlled to achieve desired values for a freeze-drying process over a prescribed time span (e.g., a production run). Specifically, the term "process conditions" is intended to refer to temperature, pressure, humidity, etc., in the process volume, wherein a process control may comprise controlling or driving such process conditions inside the process volume according to a desired process regime, for example, according to a time sequence of a desired temperature profile and/or pressure profile. While the "closed conditions" (sterile conditions and/or containment conditions) also are subject to process control, these conditions are discussed herein in many cases explicitly and separately from the other process conditions indicated above.

The desired process conditions can be achieved by controlling process parameters by means of implementing heating and/or cooling equipment, vacuum pumps, condensers, and the like. In some embodiment, the freeze-dryer can further be adapted to provide operation under closed conditions (sterility and/or containment). Generally, a production under sterile conditions means that no contaminants from the environment can reach the product. Production under conditions of containment means that neither the product, nor elements thereof including, but not limited to, excipients and the like, leave the process volume and reach the environment.

As used in certain of these embodiments, the conditions of containment and/or sterility are understand to include conditions of relative containment and/or sterility; such that a relative measure of product sterility is achieved, as determined by routine assays and testing procedures in view of the final product specifications for minimum and maximum contaminant levels. Moreover, for any specific device/process line, the terms "sterility" ("sterile conditions") and "containment" ("contained conditions") are to be understood as required by the applicable regulatory requirement for that specific case. For example, "sterility" and/or "containment" may be understood as defined according to Good Manufacturing Practice ("GMP") requirements and the like.

According to various embodiments, the drum is adapted for use within a vacuum chamber of the freeze-dryer. The vacuum chamber may comprise a confining wall which provides hermetic enclosure, i.e., hermetic separation or isolation, of the confined process volume from an environment (thereby defining the process volume). The drum can be arranged entirely inside the process volume.

In some embodiments, the drum is generally open, i.e., the portion of the process volume internal to the drum is in open communication with that portion of the process volume external to the drum. Process conditions such as pressure, temperature, and/or humidity tend to equalize between the internal and external process volume portions. In particular, any pressure differences between the internal and external volumes will be limited. Therefore, the drum is not limited to particular forms or shapes typically known for example for pressure vessels. Therefore, the front plate and/or rear plate can be of generally conical or dome-like form, e.g., may be formed as a dished dome or cone, or can be of any other form appropriate for a particular employment scenario. The drum main section can be of a general shape appropriate for carrying the particles, for example, a generally cylindrical shape.

With regard to a bulk product flow into and out of the drum and freeze-dryer, generally the following notation is adhered to "charging/discharging" relates to a flow of particles into/out of a freeze-dryer, while "loading/unloading" relates to a flow of particles into/out of the drum. However, in some embodiments and in some Figures an opening at/on the drum provided for loading/unloading is also referred to as a "charging/discharging opening".

In some embodiments, the rotary supporting shaft and a driving mechanism for the shaft are arranged entirely inside the freeze-dryer, e.g., the vacuum chamber. This configuration avoids the shaft traversing through the confining wall of the vacuum chamber. This is contemplated to avoid much of the complexity and problems with sealing the driving mechanism against the process volume such as the potential for pollution due to attrition, etc. Alternatively, the rotary supporting shaft traverses the confining wall, such that the driving mechanism is arranged outside the process volume (vacuum chamber). In the latter approach, the traversal of the supporting shaft is sealed, for example, by means of one or more vacuum traps in order for maintaining closed conditions inside the process volume (vacuum chamber).

"Permeability" may be understood as being permeable for sublimation vapor (in general water vapor, and/or any other vapor of solvent), wherein the smallest opening allowing the traversal of vapor and therefore providing "permeability" may be seen as an opening of a size at or above the sizes of the molecules or other constituents of the vapor. For practical reasons one may consider the smallest reasonable opening (in a mesh, fabric, or similar material) of a size where a viscosity of the vapor does not play a considerable role in preventing traversal of the vapor. In order to provide suitable particle-retaining capability of the chosen material, the openings in the material should be smaller than the minimum size range of the (desired or theoretical size) particle distribution.

According to various embodiments, both rear and front plates are permeable for sublimation vapor. In some embodiments, the front plate, for example, comprises one or more charging opening(s) for charging and optionally discharging the particles. In these or other embodiments, the rear plate is additionally, or alternatively, involved in charging and/or discharging. For example, charging (loading) can be achieved via one or more openings in the front plate, and discharging (unloading) can be achieved via one or more openings in the back plate. While in some other embodiments, such charging/discharging opening(s) can be designed to be impermeable to sublimation vapor, in other embodiments the permeability of the front (and/or rear) plate to sublimation vapor is achieved at least in part via the actual aperture of the charging/discharging opening.

In preferred embodiments, the permeability of at least one of the rear plate and front plate is adapted so as to avoid choked flow limitations during a freeze-drying process. If conditions of choked flow limitation (or "choke flow limitation") occur, this means that a velocity (or mass flow rate) of sublimation vapor drawn out of the drum by a vacuum pump approaches its physically allowed maximum value. For particles in the micrometer range, when vapor velocities approach choke flow conditions (i.e., choke flow conditions have not yet or not yet fully been established), generally the velocities are large enough to carry the some microparticles out of the drum. In other words, the effect becomes increasingly important with decreasing size of the particles. Therefore, production of small particles (approaching, e.g., scales below 100 μm or even nanoscales) should be avoided and a narrow particle size distribution with a lower size limit is typically advantageous in this respect. In order to avoid reducing the efficiency of the freeze-drying process, in preferred embodiments, the permeability of one or both of the rear plate and front plate of the drum is designed such that choke flow conditions can be avoided for the planned process regimes.

Generally, the permeability of the front and/or rear plate is chosen to maximize the opening/permeable area for venting vapor from the drum and to substantially keep the particles reliably inside the drum during loading and drying including substantially keeping the particles inside the drum while rotating. In embodiments comprising a permeable rear plate, the rear plate can serve two functions: first, the plate provides for connecting to the rotary supporting shaft, and second, the plate is permeable to sublimation vapor. When considering how to provide a given drum with the desired permeability properties to thus avoid choke flow conditions, the front and rear plates of the drum are the primary structures that can be adapted in this regard, since the main section of the drum (at least in the case of an essentially horizontally aligned and rotating drum) is covered by product. The desired permeability of the terminating plates (front and/or rear plates) can in some embodiments be achieved by simply providing one or more appropriate venting holes in one or both of the plates.

In cases where both the front and rear plates are permeable to sublimation vapor, in some embodiments, the permeability of the rear plate and the permeability of the front plate are adapted relative to each other according to the respective flow path lengths of sublimation vapor to a vacuum pump and/or condenser provided for maintaining the vacuum inside the vacuum chamber. While there are several design options for setting the relative flow path lengths extending through the vacuum chamber and/or condenser, e.g., the placing of an opening towards the vacuum pump, the relative permeability of the rear and front plates should also be considered in this respect. This feature/design option is contemplated to contribute to general design flexibility. For example, in the case where one of the path lengths is shorter than the other, the permeability of the corresponding plate can be designed to be higher (more permeable) in order to avoid choke flow limitations that otherwise could occur along this shorter path.

According to various embodiments, the rear plate may comprise at least one venting hole for removing sublimation vapor from the rotary drum, thereby, at least in part, providing the desired level of permeability of the rear plate. The rear plate may, for example, comprise a concentric venting hole. According to some embodiments, the permeability of the front and rear plates are designed to be identical. For example, in some embodiments, one or more venting holes as provided in the rear and front plates are identical in position and size. For example, the drum may be designed symmetrically, e.g., with a purely cylindrical main section. The venting hole of the front plate can at the same time serve as a charging and/or discharging opening. In particular embodiments, therefore, the rear plate has two assigned functions, namely to provide for connection to the supporting shaft, and to provide the desired permeability for escape of sublimation vapor, while the front plate has the two assigned functions, to provide for a charging/discharging functionality, and also to provide for a desired permeability of the vapor. Such functions can be assigned differently to the front and rear plates in other embodiments. For example, it is possible to assign to one plate only any of the functions of connecting to the supporting shaft, provide for discharging, and provide for vapor permeability. In cases where all these functions are assigned to the rear plate, for example, the drum would form with its front plate an entirely closed and unconnected free end. Other design options are possible.

Referring back to embodiments comprising a venting hole on the rear plate and a charging opening also serving as a venting hole on the front plate, the size of these openings/holes may be correlated according to respective flow paths to the condenser and/or vacuum pump.

According to various embodiments, the rear plate (and/or the front plate) may comprise a plurality of venting holes. For example, in some embodiments, the venting holes are provided in the form of a regular pattern of, for example, cutouts, recesses, and/or slots. Additionally, or alternatively, the rear plate (and/or the front plate) may comprise a mesh which is permeable to the sublimation vapor. Preferably, the mesh is adapted to retain the particles inside the drum. A mesh with openings sized at or below, for example, around 100 μm, is contemplated to provide for high vapor permeability while at the same time reliably retaining the particles in the rotating drum.

According to various embodiments of the invention, the rear plate is adapted for centrally connecting with the supporting shaft. For example, the rear plate may comprise a central connection unit for connecting with the supporting shaft. Vapor permeable areas can still be provided centrally, as will be described below in the examples, or can be provided in a concentric, but decentralized fashion. For example, two, three, four, or more, concentric, e.g., ring- or annular-shaped openings or venting holes may be provided around a central connection unit.

Additionally, or alternatively, the rear plate can be adapted for connecting with the supporting shaft via one or more laterally extending supporting bars. These bars may extend from an annular section of the rear plate and/or a connection unit. In one embodiment, the laterally extending supporting bars carry the central connection unit, such that the area between the bars which is not covered by the connection unit can be adapted for a desired permeability, i.e., such area(s) may comprise openings, venting holes, meshes, etc., as desired. In one embodiment, the rear plate comprises a circumferential collar for retaining the particles within the rotary drum during loading and/or freeze-drying, i.e., rotation of the drum. The supporting bars can extend from the circumferential collar for carrying the central connection unit. According to this or other configurations, a central opening encompassed by the circumferential collar is covered in part by the connection unit, wherein according to the desired permeability of the rear plate a covering size of the connection unit is appropriately selected and the connection unit can optionally be offset to some degree with respect to the collar along an axis perpendicular to the rear plate.

The connection unit can comprise one or more connectors provided for connecting with at least one or more of the following: temperature control circuitry, tubes for carrying liquid and/or gases/vapor, such as tubes for carrying cleaning/sterilization medium(s), and sensing circuitry. Sensing circuitry, tubing or piping (the terms "tube" and "pipe" are used generally interchangeably herein, can generally be referred to as "connection lines") are preferably guided along the supporting shaft. For example, the connection lines can optionally be guided inside a hollow shaft traversing via confining walls of a freeze-dryer, such that the connection lines enter/leave the process volume via the connection unit.

In some embodiments, connectors provide a connection of the connection lines to corresponding circuitry or tubing associated with the drum. For example, temperature control circuitry may comprise tubing/piping for a heating and/or cooling medium, and/or may comprise electrical circuitry for electrical heating or cooling, such as via Peltier elements, microwave heating, etc. The corresponding heating/cooling equipment can be provided in association with the rear plate, main section, and/or front plate.

Similarly, in still further embodiments, tubes for cleaning and/or sterilization mediums can be provided at the drum and connected to external reservoirs via the connection unit. For example, the rotary drum can be adapted for "Cleaning in Place" ("CiP"), and/or "Sterilization in Place" ("SiP"). Additionally, or alternatively, the drum can be equipped with sensing circuitry such as sensor elements connected with external power supply and external control circuitry via corresponding lines. In particular embodiments, the main section of the drum comprises double walls, wherein connection lines for heating, cooling, sensing, cleaning, sterilization, etc., can be guided within the walls. For example, heating/cooling tubes can be provided inside the walls for heating and/or cooling an inner wall of the drum.

In some embodiment, at least one of the rear plate, front plate, and main section of the drum comprise one or more baffles for at least one of mixing within the rotary drum and conveying the particles into the drum (loading) or out of the drum (unloading), or within the drum (e.g., for distributing the particles within the drum). For example, baffles can be provided which act as retaining baffles in order to keep the particles inside the drum, and/or to achieve mixing and thus an optimized "effective" product surface (the product surface in fact exposed and therefore available for heat and mass transfer, wherein the mass transfer may in particular include an evaporation of sublimation vapor), and product homogeneity. Additionally, or alternatively, these or other baffles can be provided for retaining the particles in the drum if the drum is rotated in a particular sense of rotation, while the baffles support an unloading of the particles when the drum is rotated in another sense of rotation.

According to various embodiments, at least one of the front plate and/or the rear plates is equipped with cooling/heating means, sterilization/cleaning means, and/or sensing means. According to one of these embodiments, the rear plate is adapted to implement one or more of the above objectives. The drum may comprise a main section terminated on a rear end by the rear plate. The rear plate is optionally adapted for connection with a rotary supporting shaft for rotary support of the drum. At the same time, the rear plate is permeable for sublimation vapor from freeze-drying the particles in the rotary drum. Specific embodiments of such rear plates are discussed herein.

According to still further embodiments of the invention, a device is provided that comprises a rotary drum according to any of the embodiments outlined herein, and a rotary supporting shaft mounted to the drum. According to various embodiments of this device, the supporting shaft can be a hollow rotary shaft. In some embodiments, the supporting shaft carries means (connection lines) along and/or inside thereof for transporting at least one of a temperature control medium, a cleaning medium and a sterilization medium. Such means can comprise, for example, tubing or piping. Additionally, or alternatively, the supporting shaft may carry for example power supply circuitry and/or signal lines such as control circuitry for controlling equipment of the drum or sensing circuitry connecting to sensing elements on the shaft and/or the drum.

In cases where the hollow shaft is sealably connected with a connection unit of the drum (and/or other elements of the rear plate), the inside of the hollow shaft can be separated from the process volume within the freeze-dryer, which simplifies the provision of a temperature control medium, power supply, etc., to the rotary drum inside the process volume, but preferably requires that the connectors at the connection unit be adapted to reliably seal the process volume from the interior of the hollow shaft. In such configurations, the rotary shaft traversing a process volume confinement of the freeze-dryer is sealed, and the connectors for traversing the connection lines via the connection unit are sealed wherein, however, the connection lines and the connection unit are at rest with respect to each other therefore simplifying the sealing requirement.

According to a still further embodiment of the invention, a freeze-dryer for the bulkware production of freeze-dried particles under vacuum is provided to achieve one or more of the above-indicated objectives. The freeze-dryer can comprise a rotary drum for receiving the frozen particles and a stationary vacuum chamber housing the rotary drum. The drum comprises a main section terminated by a front plate and a rear plate. The rear plate is connected with a rotary supporting shaft for rotary support of the drum. Further, the rear plate is permeable for sublimation vapor from freeze-drying the particles. The rotary drum can be designed according to one or more of the various embodiments described herein. The vacuum chamber is preferably adapted for closed operation.

According to various embodiments, the freeze-dryer comprises at least one vacuum trap for sealing a passage of the rotary shaft extending from external into the inside of the vacuum chamber (the process volume) for supporting the drum. The freeze-dryer can comprise a vacuum pump, which is provided in a second chamber in communication with the vacuum chamber via a communication tube. The communication tube can be equipped with a sealing valve. The second chamber can also comprise a condenser.

According to particular embodiments of the freeze-dryer, a flow path of sublimation vapor from a permeable front plate of the drum to the communication tube and a flow path of sublimation vapor from the permeable rear plate to the communication tube are about equal in length. This particular design feature can, in one regard, be achieved by providing an opening of the tube in a wall of the vacuum chamber at an appropriate position in relation to the drum. In these cases, the permeability of the front and the rear plate can also be adapted to be about equal. This feature does not however require the identical configuration of openings, venting holes, meshes, etc., on rear and front plates. According to one example, the front plate comprises a single opening or venting hole employed also as a dis/charge opening, while the rear plate comprises a plurality of venting holes providing in total a similar permeability.

According to other embodiments of the freeze-dryer, the flow paths from the front and rear plate, respectively, to the condenser and/or vacuum pump differ in length and the permeability of the front and rear plate, respectively.

An axis of symmetry and/or rotation of the drum can be essentially horizontally aligned, at least during a freeze-drying process. Such configuration may be advantageous for improving choke flow limitations as a design solution for a the desired permeability at the front and/or rear plates. According to particular embodiments of drums prepared for horizontal alignment, one or more openings or venting holes can be provided per plate, preferably in a concentric fashion and optionally in a similar way for both the front and rear plate. On the other hand, in some embodiments a drum can be prepared for a permanent or temporary inclination, which can require depending, e.g., on desired maximum filling level and degree of inclination, provisions for keeping the particles inside the rotating drum while at the same time achieving high vapor permeability. Meshes and/or fabrics or similar means can be used.

The horizontal alignment of the rotation/symmetry axis of the drum during, e.g., freeze-drying, does not prevent the drum from being inclined during other processes or process phases, for example, during loading, unloading, cleaning and/or sterilization processes. For example, the drum can be arranged to be inclined or inclinable for at least one process such as draining of a cleaning liquid in the cleaning process, draining of a condensate in the sterilization process, and/or discharge of the product in the discharging process. According to specific embodiments, the freeze-dryer can be adapted for CiP and/or SiP. Generally, the drum can be adapted for a permanent (slight) inclination from about, e.g., 1.0-5.0 degrees. A slight inclination is contemplated to not hinder or prevent employing drums with, e.g., identical front and rear plates, depending on the desired filling level of the drum.

According to still further embodiments of the invention, a process line for the production of freeze-dried particles under closed conditions is provided in order to achieve one or more of the above-indicated objectives. The process line can comprise a transfer section that is provided for a product transfer between a separate process device and the freeze-dryer under closed conditions. Each of the freeze-dryer and the transfer section can separately be adapted for closed operation such that a common isolator is unnecessary. The transfer section can comprise a charging funnel protruding into the rotary drum without engagement therewith. For example, the protrusion can extend via a charging opening in the front plate of the drum.

According to another embodiment of the invention, a process for the bulkware production of freeze-dried particles in a vacuum is provided in order to achieve one or more of the above objectives, wherein the process is performed using an embodiment of a freeze-dryer as described herein. The step of freeze-drying the particles in the rotating drum of the freeze-dryer comprises controlling the flow of sublimation vapor out of the rotating drum via the permeable rear plate and, optionally, a permeable front plate such that the particles are retained inside the drum. In particular, the process can preferably be controlled in order to avoid choke flow conditions that may lead to particles being carried out of the drum. In some embodiments, the process is controlled strictly to avoid choke flow conditions. For example, the process can be controlled such that the velocities of the escaping sublimation vapor are kept below a threshold value that is chosen to be at or below the known, calculated, or observed choke flow velocities.

In order to control the process at or below choke flow conditions, for example, one or more of the following process conditions can be accordingly controlled: the temperature within the process volume, the pressure within the process volume, and/or the rotation of the drum. The latter option influences the effective product surface area which is available for sublimation. The process can be accordingly controlled by controlling appropriate process parameters associated with process equipment such as, e.g., heating/cooling equipment, the activity of the vacuum pump(s), the drive of (the supporting shaft of) the drum. For example, a feedback control system including automatic evaluation of sensor equipment within the process volume can be established.

Controlling a process regime to proceed at or below choke flow conditions opens the possibility of minimizing drying times for optimum product properties such as a desired degree of dryness (residual moisture level). In the cases where a drum with optimized permeability according to the invention is employed, choke flow conditions occur only at higher levels of intensity of the freeze-drying compared to employing conventional drums. Therefore the process can be controlled (optimized) in certain embodiments to provide for a more intense sublimation and shorter drying times.

In some embodiments, the process is performed under closed conditions, i.e., under sterile conditions and/or containment. For example, for the production or processing of the particles under closed conditions the vacuum chamber can be adapted for closed operation during processing of the particles while the drum is in open communication with the vacuum chamber.

The vacuum chamber may comprise a confining wall, wherein the confining wall is hermetically separating or isolating the process volume from an environment, thereby defining the process volume. The vacuum chamber can be adapted for closed operation during loading of the drum with the particles, freeze-drying of the particles, cleaning of the freeze-dryer, and/or sterilization of the freeze-dryer. Furthermore, the drum can be confined within the process volume, i.e., the rotary drum can be arranged entirely inside the process volume.

According to various embodiments, the confining wall of the vacuum chamber may at least contribute to establishing and/or maintaining desired process conditions in the process volume during, e.g., a production run and/or other operational phases (process steps) such as a cleaning and/or sterilization operation.

Both the vacuum chamber and the drum can contribute to providing desired process conditions in the process volume.

For example, the drum can be adapted to assist in establishing and/or maintaining desired process conditions. In this regard, one or more cooling and/or heating means can be provided in and/or in association with the drum for the heating and/or cooling of the process volume.

ADVANTAGES OF THE INVENTION

The invention provides design concepts for rotary drums in freeze-dryers. Employment of rotary drums in freeze-dryers significantly reduces drying times compared to vial- and/or tray-based drying techniques. The present invention is not intended to be limited to any particular mechanism or action, however, it is contemplated that mass and heat transfer is accelerated due to the increased effective product surface achieved during rotation of the drum. Heat transfer needs not take place through the frozen product, and the layers for diffusion of water vapor are smaller compared to, e.g., drying in vials. Homogenous drying conditions can be provided for the entire batch.

However, certain potential problems and design complexities can arise from employing a rotary drum in freeze-drying, including, providing a suitable (driving) support for the drum, providing heating and/or cooling means, providing sensing equipment for sensing the process volume conditions inside the rotating drum, providing equipment for cleaning and/or sterilization processes of the rotary drum, and the like. Additionally, the potential for occurrence of choke flow conditions can limit process efficiency in the case where a drum is housed within a process volume of a vacuum chamber. The invention provides embodiments and generally applicable design concepts for drums and freeze-dryers that provide advantageous solutions to one or more of these problems while reducing overall design complexity.

Choke flow limitations occur in a freeze-drying process because increasingly smaller particles (e.g., particles in the sub-millimeter range) become more prone to being drawn out of the drum by the escaping sublimation vapor when the process is performed under vacuum (i.e., low pressure) conditions. The invention provides drum design options allowing for increased permeability of the drum in relation to escaping sublimation vapor, such that choke flow limitations of typical freeze-drying processes are minimized or even entirely avoided. Thus, in certain embodiments, the drying process can be driven to more intense levels until just before the point where choke flow limitation occurs or until, more generally, particles are carried with the escaping sublimation vapor out of the drum. As a result, in particularly preferred embodiments, drying times are reduced as compared to certain freeze-drying techniques.

According to one aspect of the invention, in order to address choke flow limitations, it is proposed to consider the permeability of the drum for sublimation vapor with regard to not only one of the terminating (front and rear) plates or flanges of the drum, but to consider both plates in this respect; in other words, it is proposed to consider designing both, the front and rear plates, specifically with a view on sufficient permeability to address choke flow limitations. In contrast, conventional drum designs often have only one opening at the front plate for charging/discharging. Mere modifications of conventional design concepts do not adequately overcome choke flow limitations.

The present invention contemplates that optimizing the permeability of one or both of the rear and front plates will minimize the risk of choke flow by locally reducing the maximum velocity of the sublimation vapor drawn out of the drum. In one exemplary configuration, a charging opening in the front plate is provided and optionally an additional opening is provided in the rear plate, that work to reduce vapor velocity at the charging opening and thereby the risk of choke flow conditions.

The drum designs described herein are contemplated to contribute to the usefulness and applicability of the general approach of arranging an open drum within a process volume, i.e., under vacuum conditions. A corresponding design in turn allows one to avoid many of the complexities that are typically involved in confining vacuum process conditions within a rotating drum. For example, in preferred embodiments, complex sealing equipment for isolating the process volume inside the drum from the outside for purposes of loading/unloading while protecting the sterility and/or containment of the product, is not required. Such complex sealing equipment often includes either a means for reliably sealing a permanent arrangement such as a (non-rotating) charging tube protruding into the (rotating) drum, or a means for reliably sealing a temporary arrangement for loading/unloading via a sealable opening of the drum. The present invention contemplates that providing a rotary drum within a vacuum chamber yields a configuration wherein the drum can simply remain open, i.e. no sealing of the rotary drum is required during charging or discharging.

The invention additionally provides greater flexibility in terms of design solutions with regard to a vapor flow path from the front and/or rear plate via the process volume exterior to the drum to the vacuum pump, as the permeability of the plates can be designed, adapted, and controlled accordingly.

Additionally, or alternatively, still further embodiments of the invention provide a "cantilever" design for the drum, where the drum is supported by a single rotary supporting shaft. In certain of these embodiments, providing a single support minimizes potential problems such as sealing problems or problems with potential attrition seen in cases wherein two or more support engagements are provided for a rotating drum. In particular, configurations are described according to embodiments of the invention wherein an opening for loading/unloading the drum is arranged on the front plate, opposite of the single drum support on the rear plate, such that a potential source of pollution near to the product flow is avoided. Further, a single support implemented as a rotary shaft carrying the drum generally allows avoiding driving mechanisms based on, for example, chains or belts, which can be prone to attrition and subsequent introduction of pollution into the process volume and/or product. Embodiments that avoid these and other such mechanisms, which would require inclusion of complex features to minimize pollution inside the process volume, are further examples of the reduced complexity and lower design costs which can be achieved according to the present invention.

The present invention contemplates that the cantilever design discussed here simplifies cleaning and sterilization as compared to complex drum arrangements with multipoint support, e.g. a drum supported by multiple roller block bearings with chain drive, wherein for example attrition may negatively affect a quality of the product. Further, the present invention contemplates that the cantilever design discussed herein allows for the optimization of the front (plate) side of the drum, for example, for dis-/charging, a vapor permeability, etc. Still further, the cantilever design allows to provide for inclining/declining the drum with one or more simple means (as compared to any kind of multipoint support), wherein only the rotary supporting shaft needs to be arranged such that the drum is either permanently inclined, or temporarily inclinable. The inclination may, for example, be adjustable through various continuous/discrete inclination/declination positions to better facilitate various exemplary processes including, but not limited to, charging, freeze-drying, discharging, cleaning, and/or sterilization.

Furthermore, the cantilever design offers a favorable means of supplying cooling and cleaning media or cabling to the rotating drum. Specifically, various devices can be provided in association with the drum, which may be related to, for example, sensing, heating, cooling, cleaning, and/or sterilization. Connection lines for equipment such as power supplies, signaling lines, and/or tubes or pipes can be routed along, or even through, the supporting shaft and may thus enter and leave the process volume via the rotary shaft. In cases where the inside of the shaft is exterior to, i.e. outside of the process volume, a (vacuum-tight) seal is required at the shaft for protection of sterility and/or containment of the process volume, including concern for any traversing connection line. A static sealing only is required for the connection lines when entering/leaving the process volume insofar as shaft and drum are mounted in fixed mechanical relationship to each other. The connection lines need to be adapted to the rotary property of the shaft and drum, which can however be attended to separately (and in particular outside the process volume, which can mean that any coupling to stationary equipment via connectors and the like can be performed, for example, under normal atmospheric conditions).

The embodiments described herein and other exemplary embodiments exemplifying these approaches thus provide considerable flexibility in terms of available design options for employing rotary drum devices in freeze-drying devices and process lines, in which these devices can be employed. Depending on the process goals related to an optimized combination of one or more of, for example, the desired dryness (residual moisture level) of the product, drying times, and the batch volumes to be processed, etc., the permeability of the drum can be controlled by providing for the appropriate permeability of one or both the rear and front plates. Other functions, such as loading and unloading the drum, connecting with a support, etc., can be assigned to the front and rear plates depending on the desired specific application. The drum can also be designed/optimized in view of the requirements related to other parts of a freeze-dryer, for example, the position of the vacuum pump, a charging/discharging mechanism employed in conjunction with the freeze dryer, a desired inclination of one or both of vacuum chamber and drum for different process phases, etc.

Generally, the inventive design approaches also allow full enablement for CiP/SiP for the drum and the freeze-dryer integrating the drum. Therefore, insofar as no manual interaction is required, the freeze-dryer can be permanently hermetically closed, for example, the drum can be permanently integrated within the freeze-dryer, e.g., in a vacuum chamber, and the rotary supporting shaft can be designed to permanently traverse the wall(s) of the vacuum chamber. Consequently, relatively simple means such as bolt connections can be used for reliably closing up (sealing) the vacuum chamber (the process volume) which in turn contributes to the cost-efficient design and production capabilities of devices/process lines designed according to the invention as compared to devices requiring manual intervention, e.g., disassembly for cleaning and/or sterilization, and thus are correspondingly restricted in the design.

SHORT DESCRIPTION OF THE FIGURES

Further aspects and advantages of the invention will become apparent from the following description of particular embodiments as illustrated in the figures, in which.

Figure 6:
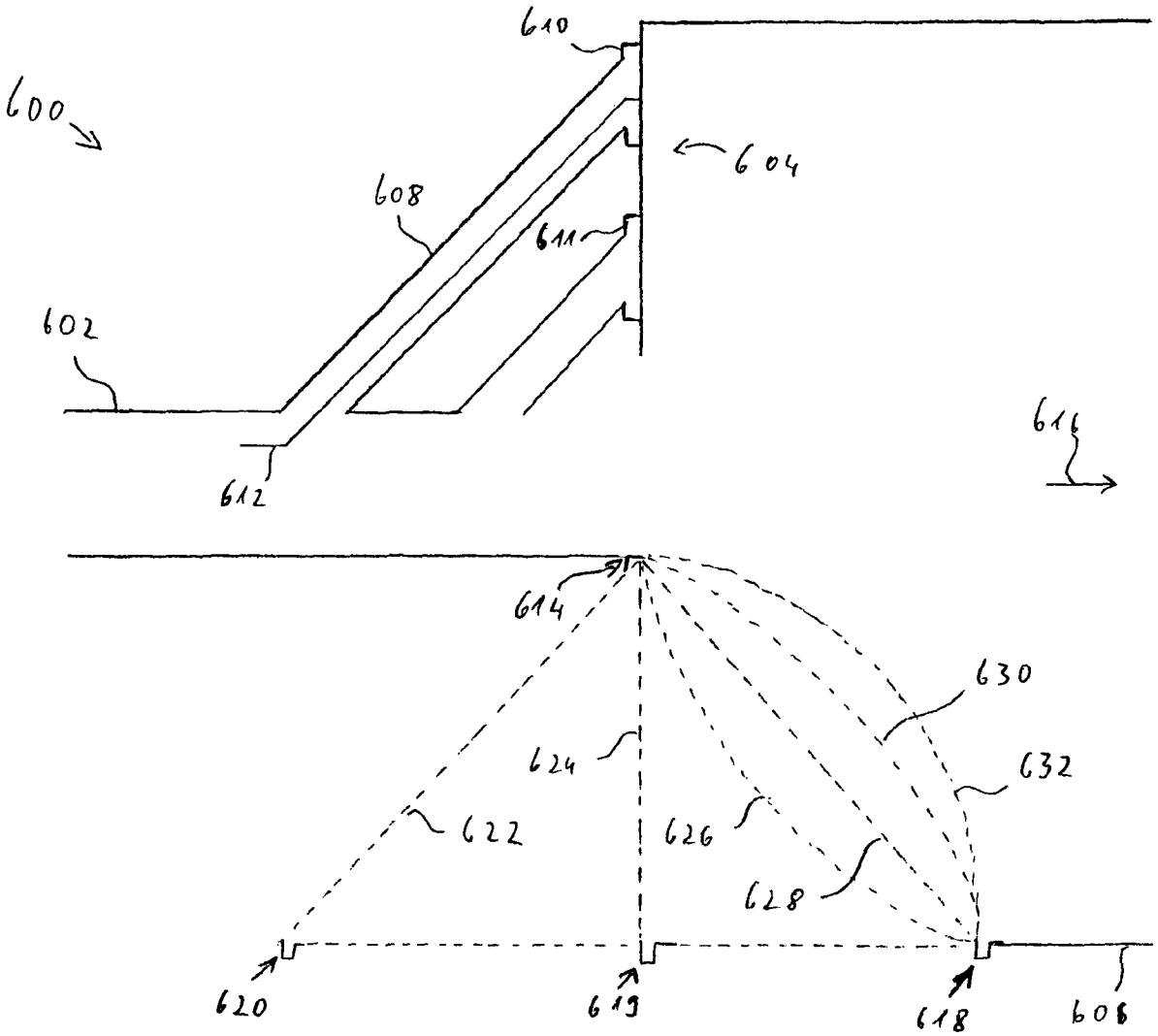
Figure 7:
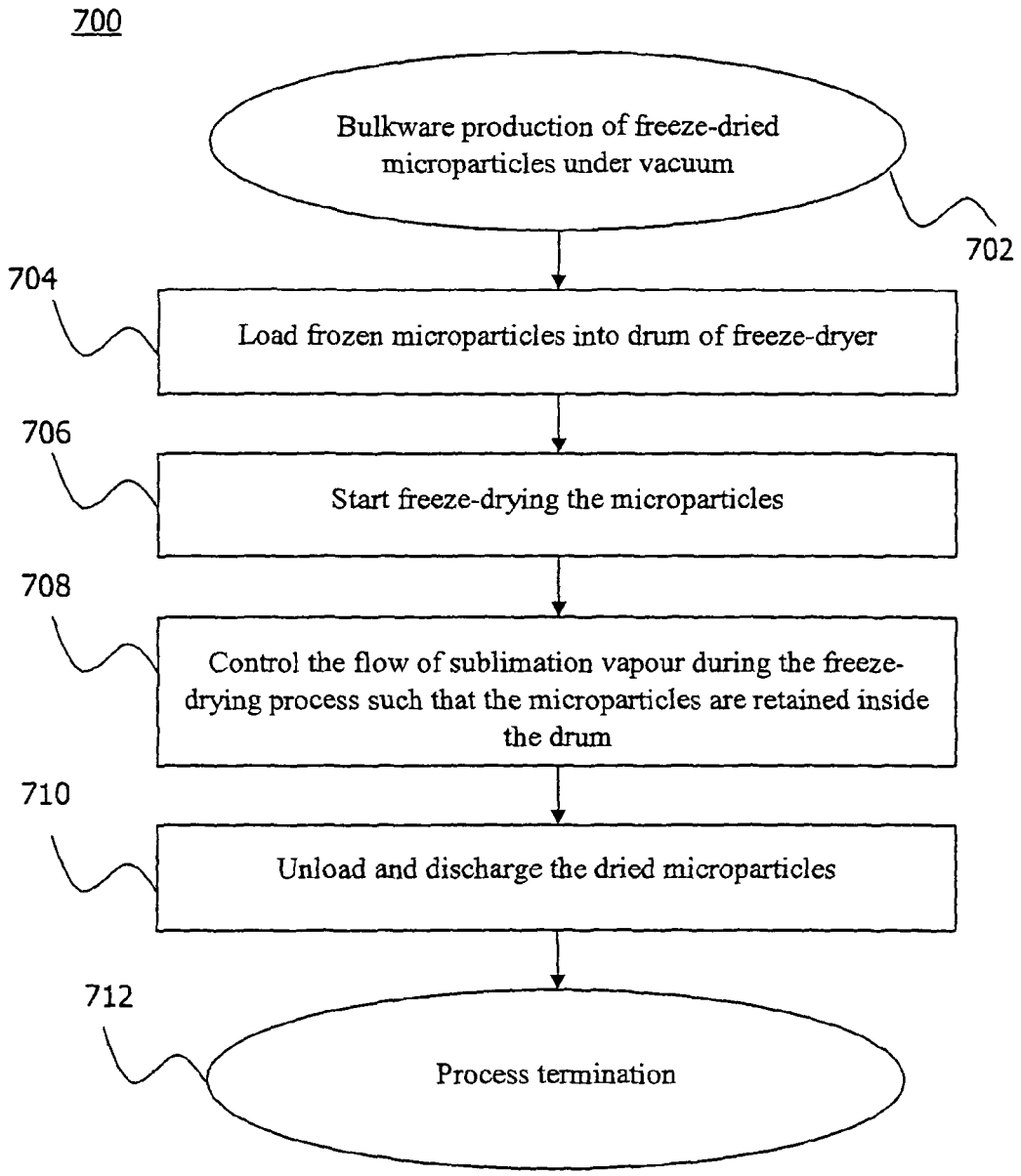

FIG. 6 schematically illustrates various rear plate profiles for a rotary drum according to the invention; and FIG. 7 is a flow diagram illustrating an operation of a freeze-dryer comprising a rotary drum according to the invention.

DETAILED DESCRIPTION OF PREFERRED EMBODIMENTS

Figure 1:
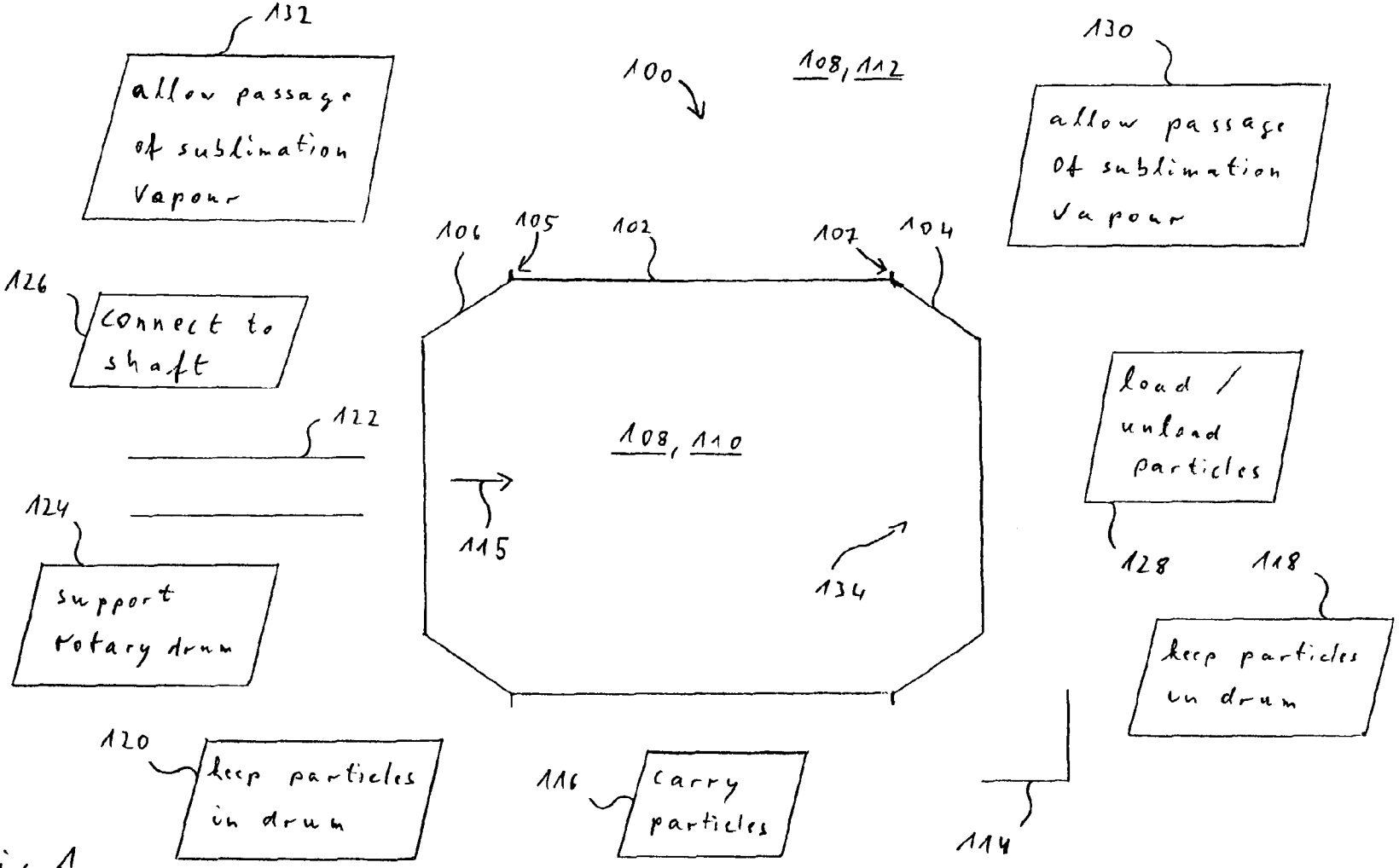
FIG. 1 is a schematic illustration of a first embodiment of a rotary drum according to the invention.

FIG. 1 is a high-level schematic illustration of an embodiment 100 of a rotary drum which is intended for use in a vacuum freeze-dryer for the bulkware production of freeze-dried particles, for example microparticles such as micropellets. The drum 100 comprises as generic components a main section 102, front plate 104 on a front end and rear plate (back plate) 106 on a rear end of the drum 100. The terms "front" and "rear" are assigned more or less arbitrarily to the end sections (terminating sections) 104 and 106. Sections 102 and 104 may be connected via joint 105 and sections 102 and 106 may be connected via joint 107, wherein joints 105 and 107 may comprise welds, flanges, bolts, etc., which can connect the sections permanently (or removably) to each other.

Drum 100 is essentially horizontally aligned along an axis 114 of symmetry/rotation. Along this general orientation, main section 102 has a pure cylinder form as illustrated in FIG. 1. Other drum embodiments may have a generally cylindrical structure or may comprise, for example, (axially symmetric) a diamond or rhombus-shaped profile, or a cone-shaped profile with a decreasing diameter towards one or more of the terminating sections 104 or 106, or may comprise a sawtooth-profile, etc.

In the embodiment described in FIG. 1, a freeze-dryer housing the drum 100 provides a process volume 108 wherein process conditions such as pressure, temperature, and/or humidity can be controlled to achieve desired values. The process volume comprises the sub-volume 110 internal to drum 100 and the sub-volume 112 external to drum 100. The process volume 108 may be confined within a schematically indicated vacuum chamber 114.

The following tasks are assigned to the device housing the drum 100 (i.e., in this example, to the vacuum chamber 114) instead of to the drum 100. First, the task of providing hermetically closed conditions. This can include providing sterility, i.e. no contamination may enter into the product, wherein "contamination" can be defined to include at least microbial contamination, and can generally be defined according to regulatory requirements such as the GMP. This can additionally or alternatively include providing containment, i.e. neither the product, elements thereof nor any auxiliary or supplementary material may leave the process volume 108 and/or enter an environment of the freeze-dryer. Second, the task of providing process volume 108 and therefore the tasks of providing process conditions according to a desired process regime within volume 108. As a result of the vacuum chamber 114 having assigned tasks 1) and 2), the drum 100 itself does not need to be hermetically closed, but is designed to be open. This, amongst others features, provides that process conditions may be (cost-) efficiently controlled by the stationary vacuum chamber 114 or equipment associated therewith and may be communicated (mediated, conveyed) from external process volume 112 into the internal process volume 110, which can contribute to simplifying a design of drum 100.

In a preferred embodiment, main section 102 of drum 100 is assigned the task 116 of carrying particles, wherein task 116 preferably includes (comprises) that section 102 is appropriately sized and designed for receiving and keeping a desired batch amount of particles. Task 116 may also include that a permanent or adjustable (i.e., to be actively controlled) inclination of drum 100/main section 102 is provided to enable one or more of the processes or process phases (operations, operational modes) of loading, drying, and/or unloading the particles. Task 116 may further include sensing bulk properties of the particles, which in turn may include sensing/detection of a loading level, a degree of agglomeration of particles during loading and/or drying, and sensing particle properties such as temperature, humidity/dryness, etc.

The drum rotational velocity during freeze-drying can be expected to have an indirect influence on the choke flow effect due to a potential increase in effective product surface and resulting sublimation of vapor. Task 116 of carrying particles may further comprise controlling (in the sense of optimizing) an effective product surface of the bulk product (i.e., the product surface exposed to be available for heat and mass transfer) that may in turn include controlling a rotation of the drum in terms of rotation frequency and (re-)orientation.

In some embodiments, maximizing the effective product surface during freeze-drying comprises controlling the appropriate rotation velocity of the drum during freeze-drying. It may also comprise controlling the appropriate rotation velocity of the drum during loading, in order to prevent agglomeration of the particles during loading. Consequently, different rotational schemes can be substituted in different processes or process phases. For example, while loading the drum 100 with particles, task 116 may impart a (comparatively slow) rotation of drum 100 in order to prevent agglomeration of the frozen particles to be dried, while during a freeze-drying process, task 116 may impart a (comparatively fast) rotation of the drum 100 in order to provide for an efficient mixing of the bulk particles. Other measures for maximizing effective product surface area include changes in rotational direction, and/or optimizing mixture of the particles by providing one or more appropriate mixing means such as mixing baffles and the like. The various measures to achieve task 116 as described here may also apply to front and/or rear plates.

Turning now to front 104 and rear 106 plates, both plates preferably being designed to fulfill the general tasks 118 and 120 of terminating the drum 100 and thus keeping (retaining) the particles inside. In particular, tasks 118 and 120 include, but are not limited to, keeping the particles in drum 100 during a loading of the drum with the particles and during a freeze-drying of the particles, taking into account that the drum may be in a different configuration in different processes/process phases with regard to, for example, rotation including rotational velocity, an inclination angle, etc.

In some embodiments, the front 104 and rear 106 plates are optimized for tasks 118 and 120 by, for example, providing a collar, flange, or similar structural adaptation to retain the bulk product in drum 100 up to the desired filling level thereof. Such adaptations can be symmetrical with respect to axis 114 of symmetry, which does not exclude collars with alternating sections of different structures such as solid sections alternating with openings or mesh. The width and angle of the collar(s) with respect to axis 114 and further design details of the one or more collars may be selected depending on desired maximum escape velocities of the sublimation vapor, rotation velocities of the drum, tendency of the frozen particles to stick to each other and the drum walls, and/or tendency of the particles to move towards a terminating side of the drum during rotation due to conveying baffles, etc. Examples for collar-type front/rear plates are known.

Task 124 of providing rotary support for drum 100 is implemented with/assigned to rotary supporting shaft 122. Task 124 may also include providing for a permanent or adjustable inclination of the drum 100. Rear plate 106 has assigned task 126 of providing a connection to supporting shaft 122. Any mounting of plate 106 with shaft 122 needs to carry a maximum weight including the weight of the empty drum 100 plus, for example, the weight of cleaning liquid and/or sterilization condensates which may fill the drum during cleaning/sterilization (wherein the drum may or may not comprise a draining facility). The weight of the particles may often be negligible in this respect, i.e., it will in most cases be smaller than the weight of a liquid filling the drum. In preferred embodiments, the connection or mounting also has to achieve a transfer of rotation from the shaft to the drum. As an example, shaft 122 may be fixedly (rigidly) connected to plate 106. In other embodiments, a flexible connection may be implemented by providing a gear mechanism and/or driving mechanism such as a motor for driving a rotation of the drum, wherein one or more gears and/or motors may be provided on a fixed supporting shaft. A flexible connection may also include a pivot providing for a permanent or adjustable inclination of drum 100.

Front plate 104 has been assigned task 128 of providing for the loading and unloading of drum 100 with particles. As drum 100 is entirely housed within process volume 108, no sealing or isolation is required along the product flow into and out of the drum. Therefore, as an example, the front plate 104 may be provided with a simple opening sufficient for allowing entry of the product flow which may be guided by product guiding means (e.g., charging funnels) in order to achieve a free flow into the drum 100 or which may itself protrude into drum 100.

Unloading may also be achieved by relatively simple means such as a means for achieving a sufficient inclination of the drum, an extra discharge opening (which may also be provided in a closable way at the main section 102), conveying baffles, discharge baffles, or funnels, and the like. One or more product guiding means for loading and/or unloading can be arranged in a stationary fashion at the vacuum chamber 114 instead of at the rotary drum 100 (e.g., dis/charge funnels), wherein such stationary means may avoid engagement with the rotary drum 100. Additionally, or alternatively, dis-/charge guiding means (such as baffles or funnels) can also be provided with drum 100 or rotary shaft 122, i.e., in a rotary fashion. This may however somewhat increase the weight supported by shaft 122. The task of charging/discharging the particles into and out of the process volume 108, which includes maintaining closed conditions during charging and discharging, is assigned to vacuum chamber 114. It is noted that separation of this task from the rotary drum generally contributes to simplifying a construction of not only the rotary drum, but also of the overall design of the drum-based freeze-dryer.

Each of front and rear plates 104 and 106 has been assigned respective tasks 130 and 132 of allowing a passage of sublimation vapor. While efficient vapor withdrawal is a general requirement for minimizing drying times, further boundary conditions should be considered such as reliably carrying the particles in the drum and avoiding the occurrence of choke flow conditions or more generally conditions which might lead to particles being carried out of the drum with the escaping vapor.

Therefore, it is generally not sufficient to keep rear plate 106 closed and provide front plate 104 with an arbitrarily sized charging opening which is then also used for withdrawing the sublimation vapor. Depending on the details of the planned processes, designs implementing a single charging opening can cause a "bottleneck" for the escaping vapor, resulting in high(er) vapor velocities in the area near the opening. For illustration purposes, an area which would be "near to" a charging opening in front plate 104 is schematically indicated with arrow 134 in FIG. 1. Particles in movement induced by a rotation of the drum during a freeze-drying process may happen to cross area 134 and may then experience a momentum transfer from the vapor which results in those particles being carried out of the drum through the charging opening. It is to be noted that the effect of the escaping vapor carrying particles out of the drum during freeze-drying is called choked flow. Nevertheless, the effect may also already occur at vapor velocities below choke flow conditions.

The choke flow effect may adversely affect not only product throughput in cases where an essential fraction of particles is drawn out of the drum during a production run but may additionally, or alternatively, lead to lengthening of drying times in cases where drying efficiency has to be reduced in order to avoid this effect.

In yet another exemplary embodiment, rear plate 106 is entirely impermeable to sublimation vapor (i.e., plate 106 would not have assigned task 132) and front plate 104 comprises an opening for loading particles into the drum (task 128). This opening would also be responsible for task 130, i.e., wherein sublimation vapor is drawn out of drum 100 through the opening. Providing an opening in front plate 104 large enough to avoid the bottleneck effect (choke flow conditions), can pose other problems such as keeping a desirable batch size inside the drum, which may be complicated when considering a possible inclination of the drum and a possible accumulation of particles near to the (large) opening mediated by conveying baffles required for later discharging, etc.

In preferred embodiments, the flexibility of design approaches is increased by providing suitable permeability for sublimation vapor on one or both of front plate 104 and/or rear plate 106. Maximizing the permeability of the front and/or back plates can be achieved by covering, for example, a portion of the opening in the front and/or back plate with a mesh permeable for the vapor but with openings small enough to retain the particles (e.g., microparticles) in the drum however still large enough so that viscosity effects of the vapor are minimal or absent.

Tasks 130 and/or 132 each include providing one or more openings in the front 104 or rear 106 plate to allow passage of the vapor from internal volume 110 towards external volume 112 and further to the vacuum pump. The assignment of task 132 to rear plate 106 relates to the particular degree of permeability required of the rear plate under one or more desired process regimes. The specific design of the rear plate can be optimized according to the various additional tasks 120 and 126 assigned to the rear plate 106 and according to general requirements such as cost-efficiency.

Regarding the general shape and design of the front 104 and rear 106 plates, as drum 100 is entirely included within process volume 108 (i.e., there is a comparatively small pressure differences between the interior 110 and exterior 112 volume) in some embodiments, there is no practical need for pressure-resistant shapes such as "dished-end" (or "dished dome") solutions for the respective pressure vessels. Therefore, while plates 104 and 106 can generally be shaped as cones or domes other shapes can also be selected including, but not limited to, flat ended shapes and the like.

Figure 2:
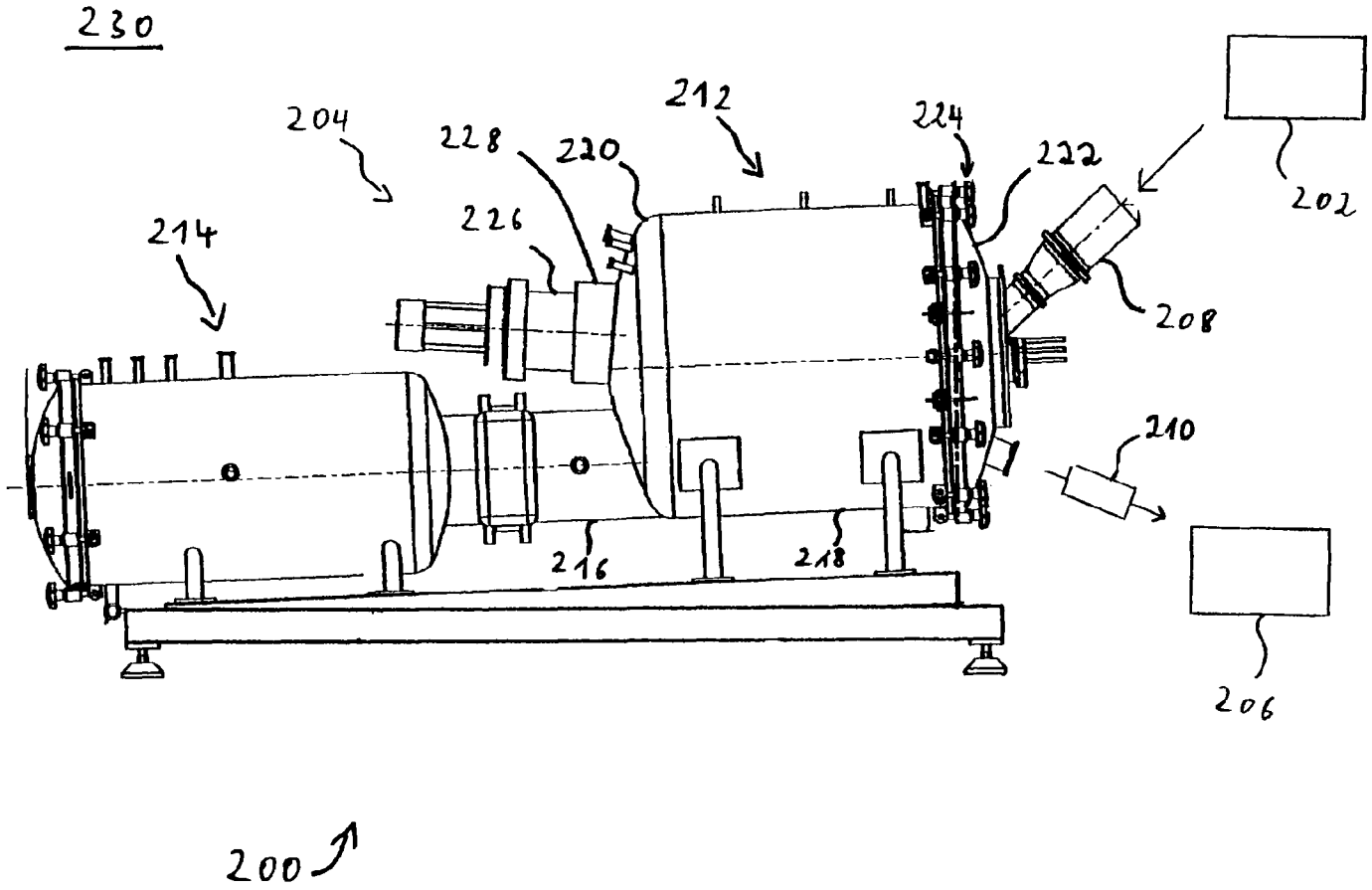
FIG. 2 is a schematic illustration of an embodiment of a process line including a freeze-dryer in a side-view.

FIG. 2 is an exemplary schematic illustration of a process line 200 for the production of freeze-dried particles (which may comprise, e.g., microparticles) under closed conditions. The process line 200 comprises a particle generator 202, a freeze-dryer 204, and a filling station 206. A transfer section 208 is provided for product transfer between generator 202 and freeze-dryer 204 under closed conditions. A further transfer section 210 (only schematically indicated) is optionally provided for product flow from dryer 204 to filling station 206 under closed conditions. At filling station 206, the product is filled under closed conditions into final recipients such as vials or intermediate containers.

In some embodiments each of process devices 202, 204, and 206 and transfer sections 208 and 210 are separately adapted for closed operation, i.e., protection of sterility and/or containment. Therefore, in preferred embodiments, there is no need to provide one or more additional isolator(s) around theses devices and/or transfer sections. And process line 200 can be operated for the production of a sterile product in an otherwise unsterile environment.

Referring in more detail to freeze-dryer 204, the device comprises a vacuum chamber 212 and a condenser 214 interconnected with a tube 216 equipped with valve 217 for controllably separating chamber 212 and condenser 214 from each other. In some of these embodiments, a vacuum pump is optionally provided in association with condenser 214 and/or tube 216. In still further embodiments, both vacuum chamber 212 and condenser 214 are generally cylindrical in shape. Specifically, the vacuum chamber 212 comprises a cylindrical main section 218 terminated by end sections 220 and 222 which are formed as cones, as seen in the example illustrated in FIG. 2. The terminating sections can be permanently mounted with main section 218, as exemplarily shown for cone 220, or may be fixedly, but removably mounted as exemplarily shown for cone 222 mounted with a plurality of bolt fastenings 224 to main section 218.

Transfer section 208 is permanently connected in some embodiments to cone 222 for guiding the product flow from generator 202 into vacuum chamber 212 under closed conditions. Further, each of main section 218 and cone 222 comprise a port 220 and 222, respectively, for guiding the product from vacuum chamber 212 via transfer section 210 towards discharge station 206.

Figure 3:
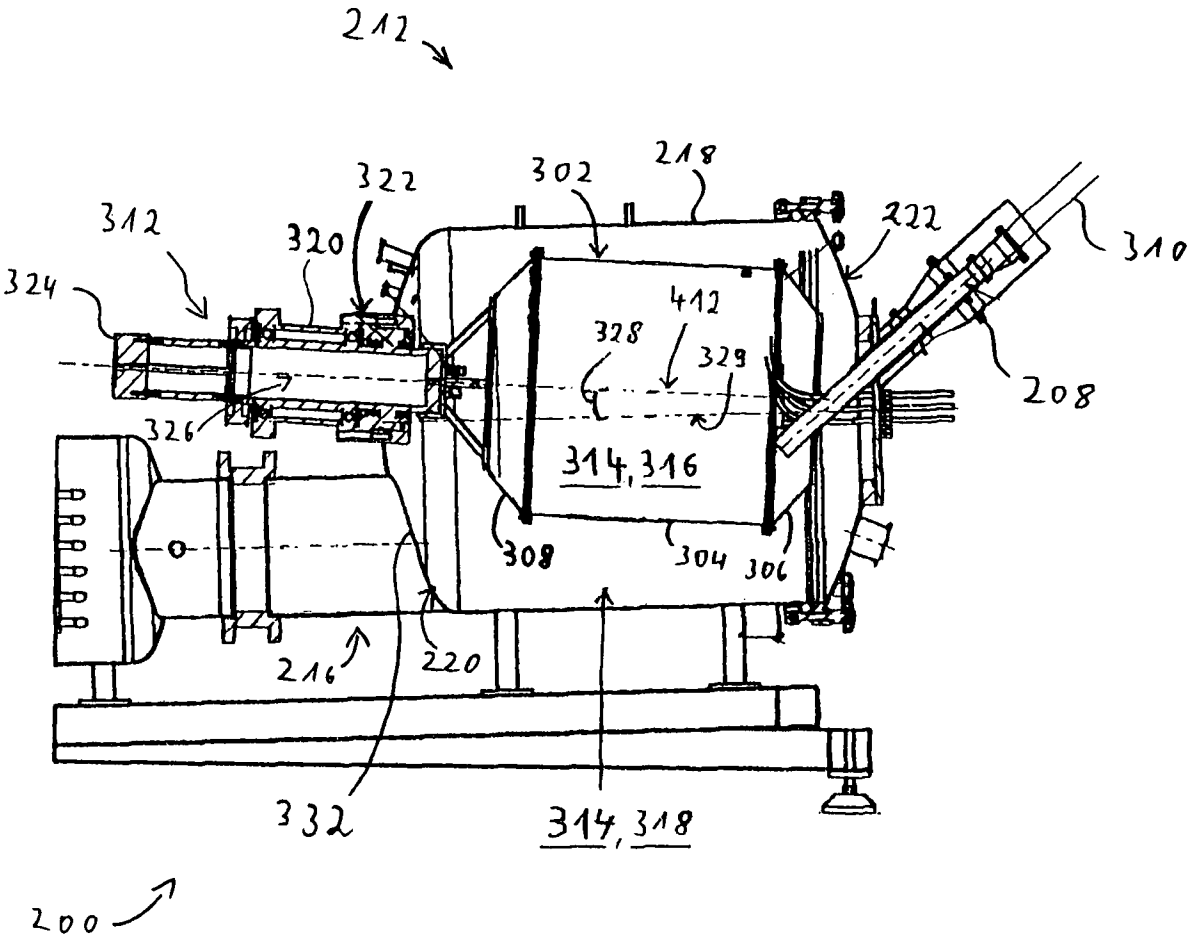
FIG. 3 is a schematic cross-sectional view illustrating the rotary drum supported inside the freeze-dryer of FIG. 2.

FIG. 3 is an exemplary cross-sectional cut-out of freeze-dryer 200 of FIG. 2 showing the interior of the vacuum chamber 212. Specifically, chamber 212 houses a rotary drum 302 adapted for receiving and carrying frozen particles for freeze-drying. Drum 302 is of generally cylindrical shape with a cylindrical main section 304 terminated by front and rear plates 306 and 308, respectively. Transfer section 208 comprises a charging funnel 310 which traverses inside outer shell 311 of transfer section 208 in a hermetically closed manner through front cone 222 into vacuum chamber 212 and protrudes via front plate 306 into the interior of drum 302 for guiding the product flow into the drum.

Figure 4:
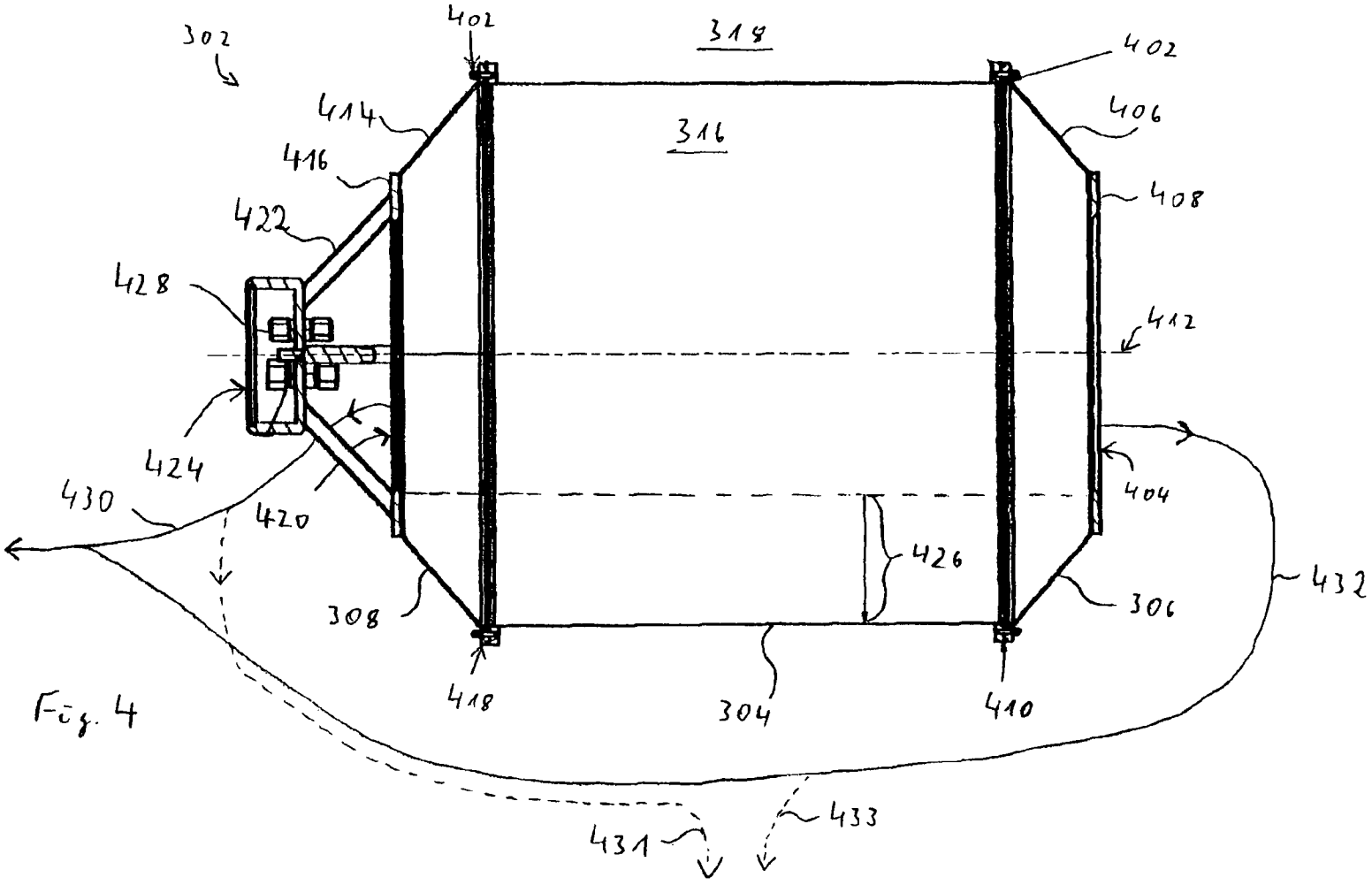
FIG. 4 illustrates in more detail the drum of FIG. 3.

FIG. 4 is a further cross-sectional isolated exemplary illustration of drum 302 of FIG. 3 showing main section 304 and front and rear plates 306 and 308 in more detail. Sections 304, 306, and 308 can be permanently connected or mounted to each other via bolted connections 402. Front plate 306 is designed in the form of a cone comprising central opening 404, i.e., front plate 306 comprises outwardly angled collar 406 the concentrical inner flange 408 thereof being offset from the outer flange 410 (connecting to main section 304) with the offset being projected along an axis 412 of symmetry of drum 302.

Main section 304 of drum 302 can be implemented as a single wall, as shown in FIG. 4, or at least in part as a double wall with a solid (inner) wall for carrying the particles during loading and freeze-drying. The various aspects which may be related to carrying particles have been discussed at length for task 116 in FIG. 1.

Referring to FIGS. 3 and 4, opening 404 enables protrusion of charging funnel 310 from transfer section 208 into drum 302 without engagement therewith. With regard to at least the size of opening 404, front plate 306 is adapted to allow loading of drum 302 according to task 128 as described with reference to FIG. 1.

In certain embodiments, rear plate 308 is formed similar to front plate 306 as an open cone with collar 414 comprising outwardly angled inner flange 416 offset to outer flange 418 along symmetry axis 412. Rear plate 308 is further illustrated in FIG. 5 in the form of a top view onto plate 308 along axis 412 indicated in FIGS. 3 and 4. Inner flange 416 of plate 308 encompasses opening 420 which (as can be seen in FIG. 4) may be similar in size to opening 404 of front plate 306. In fact, in cases where a maximum opening for providing vapor permeability is required according to tasks 130 and 132 (FIG. 1) the maximum size of a single central opening 404 and 420 in front 304 and rear 306 plates, respectively, is limited only by the desired loading capacity of drum 302.

In order to keep the particles inside drum 302, the size of openings 404 and 420 in front and rear plates 306 and 308 is sufficiently limited. In some embodiments, each of front and rear plates 306 and 308 is provided with a collar 406 and 414, respectively, wherein the collars have a width 426 which is measured perpendicular to horizontal rotational axis 412 as illustrated in FIG. 4. Width 426 is to be understood as the depth of the essentially horizontally oriented rotary drum 302 in the sense of determining a maximum filling level of the bulk product. Therefore, width or depth 426 has to be selected as discussed with regard to tasks 118 and/or 120 of FIG. 1, in order to provide for a desired batch size, and in regard to tasks 130 and/or 132 so that openings 404 and 420 provide for a desired permeability sufficiently to avoid choke flow limitations.

Figure 5:
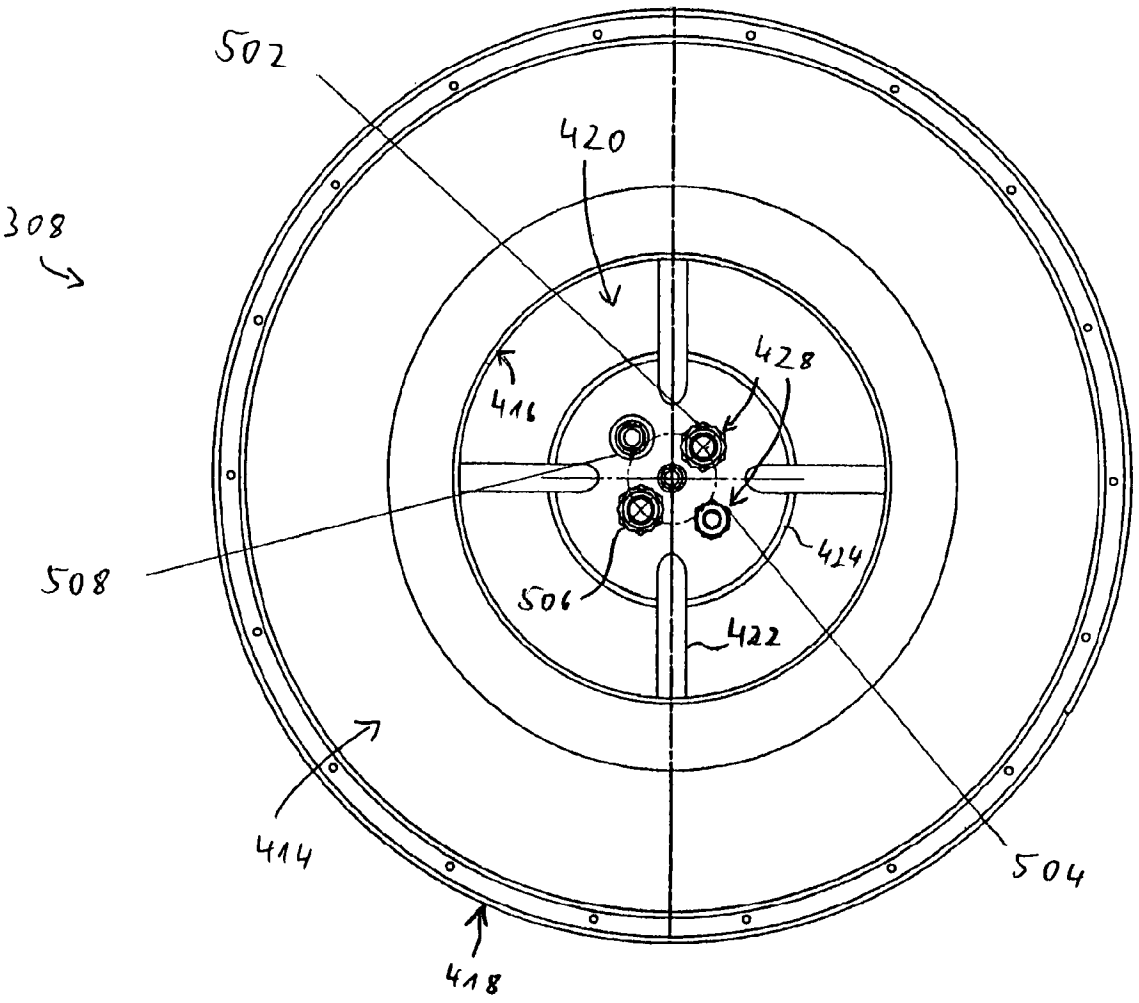
FIG. 5 illustrates in detail the rear plate of the drum of FIG. 4.

Rear plate 308, as shown in FIGS. 4 and 5, can optionally be manufactured as a separate structure for permanent or removable mounting to other components of drum 302 such as main section 304. For example, a drum can be equipped with one plate taken from a set of differently designed rear plates according to a desired support, number and types of connectors, permeability for sublimation vapor, particle filling level, etc. Additionally, or alternatively, front plate 306 can be provided as a separate entity.

Rear 306 and/or front 308 plates can comprise means such as baffles, guiding funnels, etc., for contributing to mixing and/or conveying particles within the drum, and/or to the unloading particles from the drum, etc.

Referring generally to the embodiment of the freeze-dryer 212 housing rotary drum 302 illustrated in FIGS. 2-5, vacuum chamber 212 is generally operative to provide a process volume 314 during a freeze-drying process. Process volume 314 comprises a portion 316 internal to drum 302 and a portion 318 external to the drum. As drum 302 is entirely included within process volume 314, the task of providing vacuum conditions as well as providing closed conditions (sterility and/or containment) is assigned to vacuum chamber 212 (and to connection unit 424 in case of a hollow shaft 312, discussed further below).

In some embodiments, drum 302 is supported (solely) by shaft 312 within vacuum chamber 212. Supporting shaft 312 is itself supported by bearing 226 (projected view in FIG. 2), 320 (cross-sectional view of FIG. 3). Sealing is required for the rotary shaft traversing the vacuum chamber, wherein vacuum trap 228 and 322 is provided for keeping hermetic closure of process volume 314 with respect to an environment 230. The vacuum chamber 228 and 322 is kept under low vacuum conditions (below those of process volume 314) in case of a leakage of the bearing 226 avoids a contamination of process volume 314.

A schematically indicated driving mechanism 324 provides for controllable rotation of shaft 312. By means of rigid mounting of shaft 312 with drum 302 via connection unit 424 the rotation is conveyed to drum 302. Shaft 312 is hollow, wherein an interior volume 326 of shaft 312 can be used for guiding connection lines such as circuitry, tubing, etc., for such exemplary purposes as, providing a heating medium, cooling medium, cleaning medium, and/or sterilization medium to drum 302, providing power supply and/or signal lines for sensing equipment arranged in association with drum 302 (such as temperature probes, humidity probes, etc.).

Connection unit 424 is prepared for rigid and permanent connection of drum 302 to shaft 312 thereby constituting a simple means allowing general support of the drum, conveying rotation to the drum, and allowing a fixed or adjustable inclination of the drum (task 126 discussed with reference to FIG. 1). FIGS. 4 and 5 show connection unit 424 with four connectors 428 and 502-508 wherein, for example, connectors 502 and 506 can be provided for connecting tubing for guiding a cooling and/or heating medium into and out of the drum. Connector 508 can be used for connecting a piping for feeding a cleaning/sterilization medium to drum 302, and connector 504 can be used for connecting sensor lines. The connectors 428 are adapted for connecting to corresponding connection lines on both sides, i.e., towards the interior 326 of shaft 312 and towards other components of drum 302. In case interior 326 of shaft 312 is considered external to process volume 314, connection unit 424 when mounted to shaft 312 preferably provides a hermetic sealing which includes that connectors 428 provide for hermetic closure of process volume 314, in the sense of closed conditions including at least one of protection of sterility in process volume 314 and providing containment. The connectors optionally seal any/all traversing connecting lines such as piping, tubing, power supply circuitry and the like.

As shown in the exemplary embodiment illustrated in FIG. 3, by angle 328 of axis 412 of drum 302 with respect to a horizontal line 329, drum 302 can be permanently inclined (or inclinable), which may for example be provided in order to implement the properties of self-cleaning (CiP) and/or self-sterilization (SiP) for drum 302. Other potential benefits resulting from the inclination 328 include, but are not limited to, the tendency for the loaded particles to collect near opening 404 of plate 306 for unloading, etc. Inclination of drum 302, if present during loading and/or freeze-drying, tends to somewhat limit loading capacity of drum 302. This may direct the design of opening 404 of front plate 306 to be smaller than opening 420 in rear plate 308.

Openings 404 and 420 serve as venting holes for achieving the tasks 130 and 132 (see FIG. 1) of allowing passage of sublimation vapor out of drum 302. Compared to a conventional drum with only a single charging opening of same (or nearly the same) size in a front plate, drum 302 can be configured to provide twice the opening available for venting vapor for the same maximum filling level 426.

For rear plate 308 illustrated in the figures, the requirements of providing vapor permeability while connecting to shaft 312 and at the same time provide sufficient mechanical stability to the drum, have been achieved by appropriately designed bars 422 and connection unit 424 being offset from opening 420 such that opening 420 is fully available for allowing passage of sublimation vapor. With regard to the requirement to achieve a reliable connection to supporting shaft 312, bars 422 and connection unit 424 are adapted to design relevant parameters such as the weight of drum 302 and desired rotational velocities and the like. Thus, instead of four bars 422 as illustrated in FIG. 5, more or less bars can be provided in other embodiments. Similarly, connection unit 424 can be designed larger or smaller in size (also, for example, in response to a desired number of connectors), and also the offset thereof may be adjusted according to support requirements versus permeability requirements.

While openings 404 and 420 are illustrated to be of similar size in FIG. 4, in other embodiments single central venting holes are provided in the front and rear plates, respectively, that differ in size. For example, opening 420 may be designed smaller or larger than opening 404. According to specific embodiments, the size of opening 420 can be designed depending on the desired maximum filling level 426, a required mechanical stability of rear plate 308, etc. The requirement of vapor permeability also has to be considered. In this regard, the relative flow paths of the sublimation vapor from each of the openings 420 and 404, respectively, to the vacuum pump (i.e., via process volume 318 towards opening 332 of tube 216) should to be considered. For example, for the freeze-dryer configuration illustrated in FIGS. 2 and 3, the flow path of water vapor from venting holes 420 and 404 towards opening 332 is unequal in length. This is illustrated for sake of clarity in FIG. 4 with arrow 430 indicating a flow path from venting hole 420 towards opening 332 and arrow 432 indicating a flow path from venting hole 404 towards opening 332.

While the present invention is not intended to be limited to any particular mechanism(s), it is contemplated that the unequal length of flow paths 430 and 432 can result in a tendency for opening 420, being situated nearer to the vacuum pump compared to opening 404, to be more prone to choke flow conditions than opening 404. In view of this potential observation, drum 302 can optionally be adapted by increasing the size of opening 420 as compared to the size of opening 404. In preferred embodiments, increasing the size of opening 420 does not reduce the maximum filling level 426 in view of the inclination 328 of drum 302 as exemplified in FIG. 3.

In other embodiments, where equally sized venting hole are desired, one exemplary configuration is indicated in FIG. 4 by dashed line arrows 431 and 433. In this embodiment, the connection to the vacuum pump is arranged such that the flow path lengths (and curvatures thereof) from openings 420 and 404 are more or less equal. Referring to the configuration illustrated in FIG. 3, the tube 216 would for example connect to vacuum chamber 212 centrally from below or above as appropriate.

According to other exemplary embodiments, one or more sections of the collar 414 can be made permeable. In order to keep with the desired maximum filling level a mesh or fabric material can be provided in the corresponding collar sections in this respect. Generally, openings in the mesh or fabric should be no larger than required to keep at least particles with a desired minimum size (e.g., microparticles) within the drum, which may be easier to achieve for essentially round micropellets in contrast to irregularly formed microgranules.

In some embodiments, one or more stability elements similar to bars 422 are provided that extend to flange 418 of rear plate 308. One or more sections of collar(s) 414 are replaced with a mesh or fabric as discussed above. The mesh or fabric can be stretched or spanned between the respective bars. Even though the mesh/fabric may not provide much mechanical stability it operates to keep particles inside the drum.

In other embodiments, mechanical stability is provided by (rear) plates comprise an arrangement of openings, for example a pattern of openings (with sizes larger than the particles, i.e., not a mesh) in addition to or as an alternative to a central venting hole. The openings can comprise holes, slots, or cut-outs. In one example, the slots may be constituted by the free spaces between a plurality of bars from a central point similar to the spaces between the spokes of a bicycle wheel attached to a central hub. The figures show the drum 302 being equipped with the central connection unit 424 for connecting with supporting shaft 312. Other embodiments comprises two or more such connection units for connecting with, for example, a corresponding multiple number of bars extending from a supporting shaft or forming such supporting shaft.

Openings 404 and 420 in front and rear plates 306 and 308, respectively, are described as being of fixed size/diameter. In other embodiments, front and/or rear plates comprise openings such as central venting holes having an adjustable size/diameter. For example, in certain embodiments, a drum is provided with fixed openings, which may be temporarily covered by a membrane, lid, mesh, or fabric, etc., wherein the level of coverage may vary between full coverage, partial coverage, and no coverage. For example, a flexible or resilient fabric can be employed and accordingly stretched or spanned as required according to the desired filling level, drum inclination, and/or as required for avoiding choke flow conditions (e.g., in cases where the fabric is not or only partially permeable to sublimation vapor). Generally, permeable areas such as venting holes are preferably automatically controllable, and/or may manually prepared for various production runs. A drum with adjustable and optionally controllable permeability would provide improved flexibility with regard to applicability of the drum, for example for different batch sizes, etc.

Each of front 404 and rear 420 plates can be configured as being single-walled, as illustrated, or as being double-walled or in any combination of configurations, for example, while an area of one plate may be single-walled another area of a plate may be double-walled. In one exemplary embodiment, a first circumferential collar with larger radius with reference to a central axis of symmetry comprises a double-walled structure including heating and/or cooling equipment and cleaning/sterilization equipment, while a second circumferential collar is arranged at smaller radii and comprises a single-walled structure without any further equipment for heating etc. The inner collar then comprises a mesh or other vapor permeable structure adapted to retain particles inside the drum while the outer collar may be impermeable.

FIG. 6 provides a schematic illustration of various design options that are contemplated for the connecting arrangement between a drum 600 and a supporting shaft 602, wherein drum 600 is shown comprising a rear plate 604 and main section 606, and connects to shaft 602 via rear plate 604. In one embodiment, the upper part of FIG. 6 shows bars 608 forming part of and extending from shaft 602 for connecting with multiple connection units 610 and 611 arranged on rear plate 604, wherein rear plate 604 is shown here extending laterally perpendicularly from rotation/symmetry axis 616, but may also extend laterally in a sharp or obtuse angles.

Depending on an arrangement of the connection units 610 in a circle or circles and/or in another pattern over the outside surface of rear plate 604, permeable areas can be distributed over the rear plate 604 taking into account the desired filling level.

In one example, connection units 610 are provided arranged circumferentially along the periphery of rear plate 604, i.e., the connection units 610 are arranged on a solid collar, while the inner part of rear plate comprises one or more recesses or openings functioning as venting holes. Any kind of connection lines 612 such as power supply, signal lines, tubing, piping etc., may extend along (inside) bars 608 towards drum 600.

In the lower half of FIG. 6 various design options are illustrated for shapes of bars of a rear plate or of a main body of a rear plate itself. Supporting shaft 602 is mounted to a central connection unit 614. Profiles 622-632 extending between connection unit 614 and flange 618/619/620 are intended to illustrate possible shapes of corresponding rear plates, wherein the shapes may also vary according to offset of flange 618, 619, and 620 along axis 616 with respect to connection unit 614. In cases where the drum 600 is employed within a vacuum, i.e., in the absence of substantial pressure differences between inside and outside of the drum, there is no particular related requirement for mechanical stability of the drum.

Straight bar/rear plate profile 628 coincides with the embodiment shown in FIGS. 3-5. Other configurations, such as 622 and 624, may also comprise a straight profile, but differ in offset. Profile 624 shows no offset, while profile 622 has a negative offset, i.e., shaft 602 extends into drum 600 with respect to main section 606. This latter design option offers potentially large vapor permeability due to the large area available for providing permeability, while a loading capacity of the drum is essentially undisturbed by the shaft 602 protruding into the drum 600. This design offers for example the possibility of enhancing mechanical stability by providing additional support bars between shaft 602 and main section 606.

Keeping offset 618 fixed, besides straight profile 628 other, e.g., curved profiles may be considered as exemplarily indicated in FIG. 6 with concave 626 or convex 630, 632 profiles. Curved profiles allow for larger opening areas permeable for sublimation vapor and thereby may act to reduce vapor outflow velocities, wherein the vapor flows not necessarily parallel to axis 616, but in arbitrary directions.

It is to be noted that two or more of the various design options, for example those depicted with profiles 626-632, can also be combined which allows further flexibility with regard to a large opening while providing sufficient mechanical stability as well as reliable support of the drum by the supporting shaft.

FIG. 7 is a flow diagram illustrating an operation 700 of freeze-dryer 204 including drum 302 of FIGS. 2-5. Generally, the freeze-dryer 204 can be employed in a process for the bulkware production of freeze-dried particles under vacuum (702). In step 704, the freeze-dryer 204 is charged with particles. Specifically, the particles are loaded via transfer section 208 to drum 302. The particles being freeze-dried are loaded into to the drum and the loading process continues until a desired filling level such as maximum filling level 426 is reached. In order to prevent agglomeration of the loaded frozen particles, drum 302 is preferably being rotated during the loading procedure.

In step 706, the loaded particles are freeze-dried. In preferred embodiments, the freeze-drying process is controlled (step 708) so as to maximize vapor sublimation and thereby minimize drying time, while avoiding particles being carried out of the drum. Drum 302 is provided with optimized openings 404 and 420 that act as vent holes sufficient to keep the flow velocities of sublimation vapor below a critical limit for particle loss, i.e., to avoid conditions referred to as choke flow limitations. Nevertheless, in still other batches the process may be driven near, but slightly below, choke flow conditions. The specific process conditions (process regimes) depend on chosen product specifications. For example, a small loss of microparticles with sizes below a minimum threshold may be tolerated or even beneficial in some instances. Even if the process efficiency has to be reduced to avoid particle loss (excessive loss), employment of the optimized drum devices described herein nevertheless lead to process efficiencies above that which could be reached with conventional drum designs In step 710, the drying process is finished ie., the product batch hays reached the desired level of dryness. The particles are then unloaded from drum 302 and discharged from freeze-dryer 204 via transfer section 210 to filling station 206 for filling into final recipients. In step 712, process 700 is finished, for example, by performing a cleaning and/or sterilization (e.g., CiP and/or SiP) of freeze-dryer 204 including vacuum chamber 218 and rotary drum 302.

Embodiments of devices according to the invention can be employed for the generation of sterile, lyophilized and uniformly calibrated particles such as bulkware. The resulting product can be free-flowing, dust-free and homogeneous. Such product has good handling properties and can be easily combined with other components, wherein the components might be incompatible in a liquid state or only stable for a short time, and thus otherwise unsuitable for conventional freeze-drying techniques.

The products resulting from the freeze-dryers and process lines equipped according to the invention can comprise virtually any formulation in liquid or flowable paste state that is suitable also for conventional (e.g., shelf-type) freeze-drying processes, for example, monoclonal antibodies, protein-based APIs, DNA-based APIs; cell/tissue substances; vaccines; APIs for oral solid dosage forms such as APIs with low solubility/bioavailability; fast dispersible oral solid dosage forms like ODTs, orally dispersible tablets, stick-filled adaptations, etc., as well as various products in the fine chemicals and food products industries. In general, suitable flowable materials include compositions that are amenable to the benefits of the freeze-drying process (e.g., increased stability once freeze-dried).

While the current invention has been described in relation to various embodiments thereof, it is to be understood that this description is for illustrative purposes only.

This application claims priority of European patent application EP 11 008 109.8-1266, the subject-matters of the claims of which are listed below for the sake of completeness:

1. A rotary drum for use in a vacuum freeze-dryer for the bulkware production of freeze-dried particles, the drum comprising a main section terminated by a front plate and a rear plate;

wherein the rear plate is adapted for connection with a rotary supporting shaft for rotary support of the drum, and the rear plate is permeable for sublimation vapor from freeze-drying the particles.

2. The drum according to item 1, wherein the drum is adapted for use within a vacuum chamber of the freeze-dryer.

3. The drum according to item 1 or 2, wherein the front plate is permeable for sublimation vapor from freeze-drying the particles.

4. The drum according to any one of the preceding items, wherein the permeability of at least one of the rear plate and the front plate are adapted so as to avoid choke flow limitations during a freeze-drying process.

5. The drum according to item 3 or 4, wherein the permeability of the rear plate and the permeability of the front plate are adapted relatively to each other according to respective flow path lengths of sublimation vapor to a vacuum pump provided for maintaining the vacuum inside the vacuum chamber.

6. The drum according to any one of the preceding items, wherein the rear plate comprises at least one venting hole for venting the sublimation vapor from the rotary drum.

7. The drum according to any one of the preceding items, wherein the rear plate comprises a mesh which is permeable for the sublimation vapor.

8. The drum according to any one of the preceding items, wherein the rear plate is adapted for connecting with the supporting shaft via laterally extending supporting bars.

9. A rear plate for a rotary drum for use in a vacuum freeze-dryer for the bulkware production of freeze-dried particles, wherein the drum comprises a main section terminated on a rear end by a rear plate;

and wherein the rear plate is adapted for connection with a rotary supporting shaft for rotary support of the drum; and the rear plate is permeable for sublimation vapor from freeze-drying the particles in the rotary drum.

10. A device comprising a rotary drum according to any one of items 1 to 8 and a rotary supporting shaft mounted to the drum.

11. The device according to item 10, wherein the supporting shaft is a hollow rotary shaft.

12. A freeze-dryer for the bulkware production of freeze-dried particles under vacuum, the freeze-dryer comprising a rotary drum for receiving the frozen particles; and a stationary vacuum chamber housing the rotary drum;

the drum comprising a main section terminated by a front plate and a rear plate;

wherein the rear plate is connected with a rotary supporting shaft for rotary support of the drum, and the rear plate is permeable for sublimation vapor from freeze-drying the particles.

13. The freeze-dryer according to item 12, wherein the vacuum chamber is adapted for closed operation.

14. A process line for the production of freeze-dried particles under closed conditions, the process line comprising a freeze-dryer according to item 12 or 13.

15. A process for the bulkware production of freeze-dried particles under vacuum performed using a freeze-dryer according to item 12 or 13, wherein the step of freeze-drying the particles in a rotating drum of the freeze-dryer comprises controlling the flow of sublimation vapor out of the rotating drum via a permeable rear plate and optionally via a permeable front plate such that the particles are retained inside the drum.

The invention claimed is:

1. A rotary drum for use within a vacuum chamber in a vacuum freeze-dryer for the bulkware production of freeze-dried particles, the rotary drum being rotatable, wherein the rotary drum is adapted for unloading the freeze-dried particles after the drying process is finished, and wherein the rotary drum is in open communication with the vacuum chamber and comprises a main section terminated by a front plate and a rear plate;

the rear plate is adapted for connection with a rotary supporting shaft for rotary support of the rotary drum, and the rear plate is permeable for sublimation vapor from freeze-drying the particles.

2. The drum according to claim 1, wherein the drum is adapted for use within the vacuum chamber of the freeze-dryer.

3. The drum according to claim 1, wherein the front plate is permeable for sublimation vapor from freeze-drying the particles.

4. The drum according to claim 1, wherein the permeability of at least one of the rear plate and the front plate are adapted so as to avoid choke flow limitations during a freeze-drying process.

5. The drum according to claim 3, wherein the permeability of one of the rear plate and the front plate is adapted relative to the permeability and the flow path length of the other one of the rear plate or the front plate, which is the length of a flow path of sublimation vapor from the other one of the rear plate and the front plate to a vacuum pump provided for maintaining the vacuum inside the vacuum chamber.

6. The drum according to claim 1, wherein the rear plate comprises at least one venting hole for venting the sublimation vapor from the rotary drum.

7. The drum according to claim 1, wherein the rear plate comprises a mesh which is permeable for the sublimation vapor.

8. The drum according to claim 1, wherein the rear plate is adapted for connecting with the supporting shaft via laterally extending supporting bars.

9. A rear plate for a rotary drum according to claim 1 for use in a vacuum freeze-dryer for the bulkware production of freeze-dried particles, wherein the drum comprises a main section terminated on a rear end by the rear plate.

10. A device comprising a rotary drum according to claim 1 and a rotary supporting shaft mounted to the drum.

11. The device according to claim 10, wherein the supporting shaft is a hollow rotary shaft.

12. A freeze-dryer for the bulkware production of freeze-dried particles under vacuum, the freeze-dryer comprising a rotary drum according to claim 1 for receiving the frozen particles; and a stationary vacuum chamber housing the rotary drum, wherein the rear plate is connected with a rotary supporting shaft for rotary support of the drum.

13. The freeze-dryer according to claim 12, wherein the vacuum chamber is adapted for closed operation.

14. A process line for the production of freeze-dried particles under closed conditions, the process line comprising a freeze-dryer according to claim 12.

15. A process for the bulkware production of freeze-dried particles under vacuum performed using a freeze-dryer for the bulkware production of freeze-dried particles under vacuum, the freeze-dryer comprising a rotary drum according to claim 3 for receiving the frozen particles, and a stationary vacuum chamber housing the rotary drum, the rear plate being connected with a rotary supporting shaft for rotary support of the drum, and the vacuum chamber preferably being adapted for closed operation, wherein the step of freeze-drying the particles in a rotating drum of the freeze-dryer comprises controlling the flow of sublimation vapor out of the rotating drum via a permeable rear plate and via a permeable front plate by adapting the permeability of one of the rear plate and the front plate relative to the permeability and the flow path length of the other one of the rear plate and the front plate, which is the length of a flow path of sublimation vapor from the other one of the rear plate and the front plate to a vacuum pump provided for maintaining the vacuum inside the vacuum chamber, such that the particles are retained inside the drum.

16. A rotary drum for use within a vacuum chamber in a vacuum freeze-dryer for the bulkware production of freeze-dried particles, the rotary drum being rotatable, wherein the rotary drum is adapted for freeze-drying particles, and wherein the rotary drum is in open communication with the vacuum chamber and comprises a main section terminated by a front plate and a rear plate;

the rear plate is adapted for connection with a rotary supporting shaft for rotary support of the rotary drum, and the rear plate is permeable for sublimation vapor from freeze-drying the particles.

17. A rotary drum for use within a vacuum chamber in a vacuum freeze-dryer for the bulkware production of freeze-dried particles, the rotary drum being rotatable, wherein the drum is adapted to keep the particles in the rotary drum during freeze-drying, and wherein the rotary drum is in open communication with the vacuum chamber and comprises a main section terminated by a front plate and a rear plate;

the rear plate is adapted for connection with a rotary supporting shaft for rotary support of the rotary drum, and the rear plate is permeable for sublimation vapor from freeze-drying the particles.

* * * * *